US012577001B2

(12) United States Patent
Garthaffner et al.

(10) Patent No.: US 12,577,001 B2
(45) Date of Patent: Mar. 17, 2026

(54) APPARATUSES AND METHODS FOR LOADING CONTAINERS WITH PRODUCTS

(71) Applicant: Altria Client Services LLC, Richmond, VA (US)

(72) Inventors: Travis Martin Garthaffner, Midlothian, VA (US); Tamika Murrell, Richmond, VA (US); Ahmet Ercelebi, Mechanicsville, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 18/765,817

(22) Filed: Jul. 8, 2024

(65) Prior Publication Data

US 2024/0359838 A1 Oct. 31, 2024

Related U.S. Application Data

(63) Continuation of application No. 18/463,751, filed on Sep. 8, 2023, now Pat. No. 12,060,183, which is a continuation of application No. 17/179,610, filed on Feb. 19, 2021, now Pat. No. 11,814,203.

(51) Int. Cl.

| | |
|---|---|
| ***B65B 7/26*** | (2006.01) |
| ***B65B 5/06*** | (2006.01) |
| *A24B 13/00* | (2006.01) |
| *A24F 23/00* | (2006.01) |

(52) U.S. Cl.

CPC ..... *B65B 5/06* (2013.01); *B65B 7/26* (2013.01); *A24B 13/00* (2013.01); *A24F 23/00* (2013.01)

(58) Field of Classification Search

USPC ..... 53/473

See application file for complete search history.

(56) References Cited

U.S. PATENT DOCUMENTS

| | | | |
|---|---|---|---|
| 3,206,062 | A | 9/1965 | Rappaport |
| 3,330,311 | A | 7/1967 | William et al. |
| 8,834,949 | B2 | 9/2014 | De Bortoli et al. |
| 10,220,969 | B2 | 3/2019 | Evans et al. |

(Continued)

FOREIGN PATENT DOCUMENTS

| | | | |
|---|---|---|---|
| DE | 2558708 | A1 | 7/1977 |
| EP | 2266424 | B1 | 2/2012 |

(Continued)

OTHER PUBLICATIONS

International Search Report and Written Opinion for PCT Application PCT/US2021/060495 dated Mar. 3, 2022.

(Continued)

*Primary Examiner* — Chinyere J Rushing-Tucker

(74) *Attorney, Agent, or Firm* — Harness, Dickey & Pierce, P.L.C.

(57) ABSTRACT

At least one example embodiment relates to a system for filling a plurality of containers with oral products. The system comprises a container station and a shuttle assembly. The container station is configured to provide a plurality of containers. The shuttle assembly is configured to move between a first shuttle position to receive a plurality of oral products and a second shuttle position to deposit the oral products into the containers. At least one example embodiment relates to a method of filling a plurality of containers with oral products.

20 Claims, 33 Drawing Sheets

(56) References Cited

U.S. PATENT DOCUMENTS

| | | | | |
|---|---|---|---|---|
| 10,399,712 | B2 | 9/2019 | Longest, Jr. et al. | |
| 10,518,921 | B1 * | 12/2019 | Duvekot | B65B 29/00 |
| 10,609,950 | B1 | 4/2020 | Evans et al. | |
| 2005/0155978 | A1 | 7/2005 | Parets et al. | |
| 2007/0084150 | A1 | 4/2007 | Siegel et al. | |
| 2008/0202532 | A1 * | 8/2008 | Wygal | B65B 63/02 131/111 |
| 2009/0044489 | A1 | 2/2009 | Siegel et al. | |
| 2009/0255948 | A1 | 10/2009 | Bassani | |
| 2013/0105036 | A1 | 5/2013 | Smith et al. | |
| 2016/0075671 | A1 | 3/2016 | Wagner et al. | |
| 2017/0029142 | A1 | 2/2017 | Evans | |

FOREIGN PATENT DOCUMENTS

| | | | |
|---|---|---|---|
| EP | 2546151 | A2 | 1/2013 |
| JP | S64037314 | A | 2/1989 |
| JP | 2010-536426 | A | 12/2010 |
| JP | 2019-055821 | A | 4/2019 |
| WO | 01/34475 | A1 | 5/2001 |
| WO | 2015181953 | A1 | 12/2015 |
| WO | 2020003407 | A1 | 1/2020 |

OTHER PUBLICATIONS

International Preliminary Report on Patentability for PCT/US2021/060495, dated Aug. 31, 2023 (6 pages).
Japanese Office Action for JP Application 2023-550106 dated Jun. 3, 2025, with English translation.
Office Action regarding Chinese Patent Application No. 202180097003.X, dated Jan. 23, 2026.

* cited by examiner

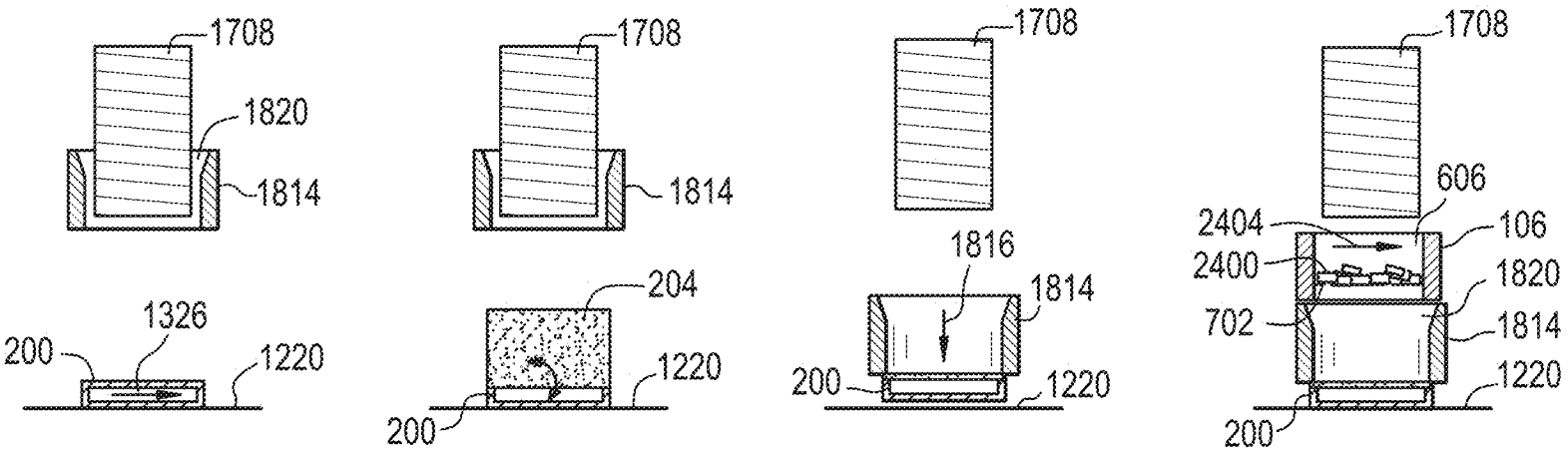
FIG. 26A
FIG. 26B
FIG. 26C
FIG. 26D
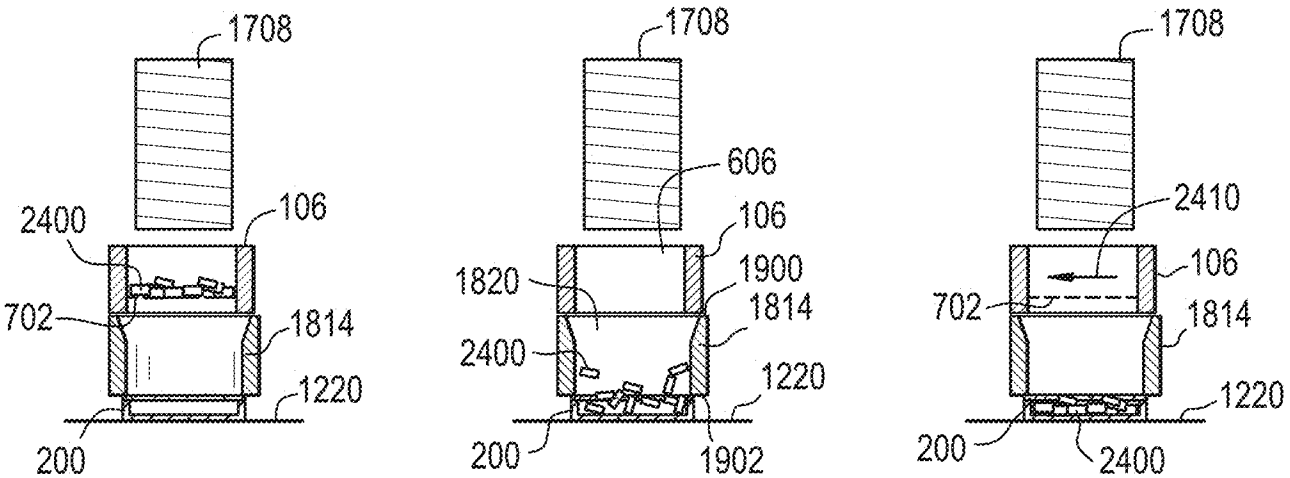
FIG. 26E
FIG. 26F
FIG. 26G

APPARATUSES AND METHODS FOR LOADING CONTAINERS WITH PRODUCTS

CROSS REFERENCE TO RELATED APPLICATIONS

This application is a continuation of U.S. application Ser. No. 18/463,751, filed on Sep. 8, 2023, which is a continuation of U.S. application Ser. No. 17/179,610, filed on Feb. 19, 2021, the entire contents of each of which is hereby incorporated by reference.

BACKGROUND

Field

The present disclosure relates to apparatuses and methods for loading a containers with products.

SUMMARY

At least one example embodiment relates to a system for filling a plurality of containers with oral products. The system comprises a container station and a shuttle assembly. The container station is configured to provide a plurality of containers. The shuttle assembly is configured to move between a first shuttle position to receive a plurality of oral products and a second shuttle position to deposit the oral products into the containers.

In at least one example embodiment, the shuttle assembly includes a plurality of receptacles and a gate. The plurality of receptacles is configured to retain the oral products. The gate is configured to move between a first gate position and a second gate position. In the first gate position, the gate extends transversely across the receptacles so as to retain the oral products within the receptacles. In the second gate position, the gate is at least partially outside of each receptacle so as to no longer retain the oral products within the receptacles.

In at least one example embodiment, the container loading station includes an arm. The arm is configured to engage the gate and move the gate between the first gate position and the second gate position.

In at least one example embodiment, the arm includes a protrusion and the gate defines a slot. The protrusion is configured to be at least partially within the slot when the arm engages the gate.

In at least one example embodiment, the container loading station includes a guide block configured to direct the oral products from the shuttle assembly to the containers.

In at least one example embodiment, the guide block is configured to move between a first guide block position spaced apart from the containers to a second guide block position to engage lids of the containers and close the containers.

In at least one example embodiment, the guide block defines a plurality of apertures through which the plurality of oral products pass.

In at least one example embodiment, the plurality of apertures define a first transverse dimension adjacent to the shuttle assembly and a second transverse dimension adjacent to the plurality of containers. The second transverse dimension is smaller than the first transverse dimension.

In at least one example embodiment, the container loading station further includes a plurality of tampers configured to move between a first tamper position spaced apart from the containers and a second tamper position at least partially within interior regions of the containers.

In at least one example embodiment, the container loading station includes a guide block and a plurality of tampers. The guide block is configured to direct the oral products from the shuttle assembly to the containers. The plurality of tampers is configured to move between a first tamper position spaced apart from the containers and a second tamper position at least partially within interior regions of the containers.

In at least one example embodiment, the shuttle assembly in the second shuttle position is between the tampers and the guide block.

In at least one example embodiment, the tampers in the second tamper position are at least partially within apertures of the guide block.

In at least one example embodiment, the shuttle assembly is configured to translate in a substantially horizontal direction between the first shuttle position and the second shuttle position.

In at least one example embodiment, the container loading station includes a piston configured to shake the containers.

In at least one example embodiment, the container loading station includes a plurality of nozzles configured to direct a fluid at lids of the containers so as to open the containers.

In at least one example embodiment, the container loading station includes a vacuum configured engage lids of each of the respective containers to retain the containers in an open position.

In at least one example embodiment, the system further comprises a container station configured to provide the containers to the container loading station.

In at least one example embodiment, the container station includes a grip and a blade. The grip is configured to squeeze opposing sides of each of the containers deform a wall thereof. The blade is configured to engage a lid and at least partially open each of the containers.

In at least one example embodiment, the container station includes a serpentine track configured to sequentially direct the containers to the container loading station.

In at least one example embodiment, the system further includes a product metering station. The product metering station includes a plurality of passages and a gate. The gate is configured to move between a first gate position and a second gate position. In the first gate position, the gate extends transversely across the passages to retain the oral products within the passages. In the second gate position, the gate is at least partially outside of each of the passages to no longer retain the oral products in the passages.

At least one example embodiment relates to a method of filling a plurality of containers with oral products. The method comprises providing a plurality of products to a shuttle assembly in a first shuttle position. The method further comprises providing a plurality of containers to a container loading station. The method further comprises moving the shuttle assembly from the first shuttle position to a second shuttle position. The method further comprises, in the second shuttle position, transferring the oral products from the shuttle assembly to the containers.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

FIG. 1A is a schematic view. FIG. 1B is a perspective view.

FIG. 2A is a perspective view of the container in a closed position. FIG. 2B is a perspective view of the container in a partially open position. FIG. 2C is a side view of the container in the partially open position. FIG. 2D is a perspective view of the container in a fully open position. FIG. 2E is a side view of the container in the fully open position.

FIG. 3A is a first or front partial perspective view. FIG. 3B is a second or back partial perspective view.

FIG. 22A is a partial perspective view. FIG. 22B is a partial top view with a housing removed.

FIGS. 2A, 2C, and 2E are front cross-sectional views. FIGS. 2B. 2D, and 2F are side cross-sectional views.

FIGS. 26A-26M are cross-section views depicting a method of loading products into containers of FIGS. 2A-2E via the container loading station of FIG. 16 according to at least one example embodiment.

DETAILED DESCRIPTION OF EXAMPLE EMBODIMENT

Figure 1A:
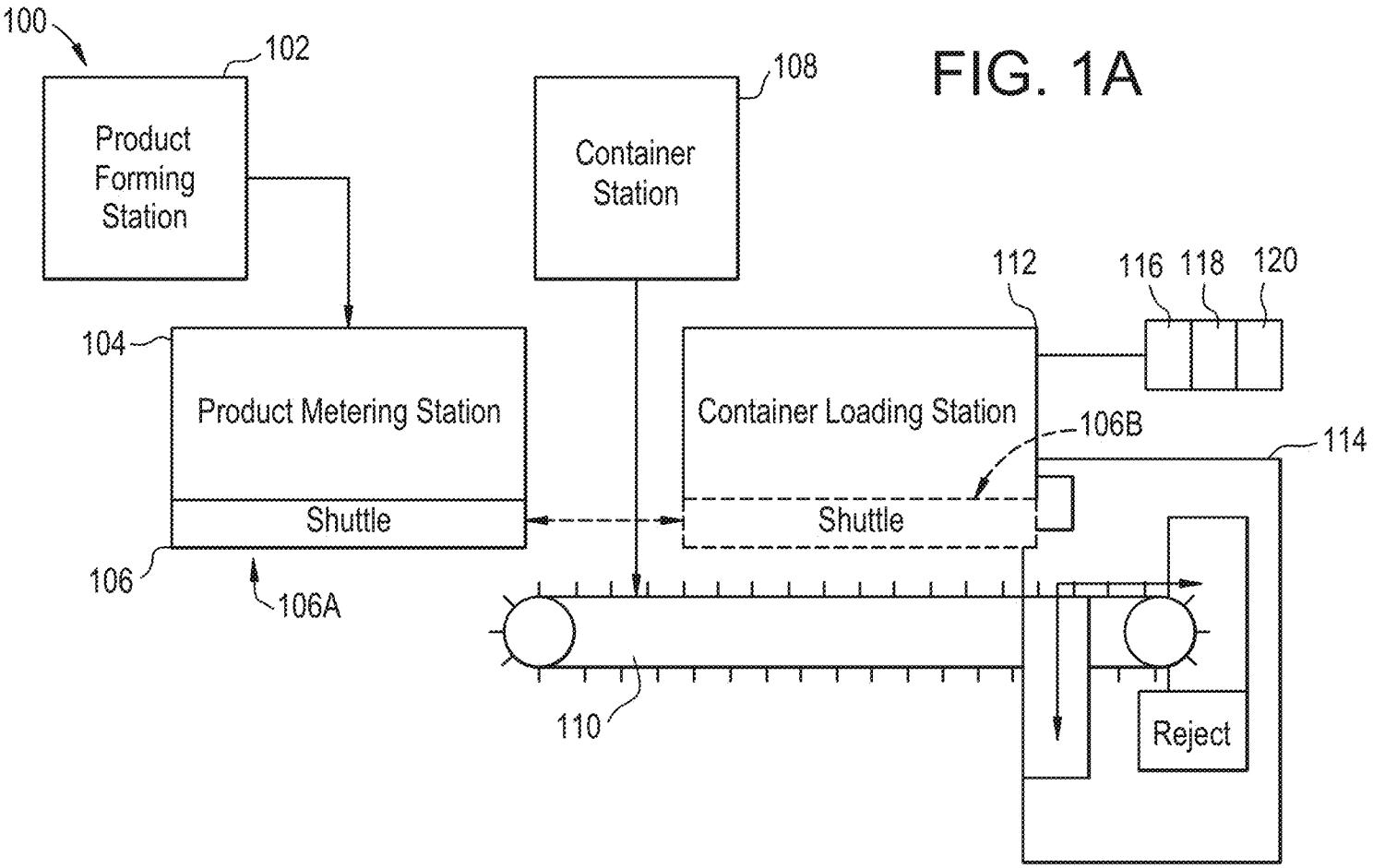
FIGS. 1A-1B depict an apparatus for filling a plurality of containers with products according to at least one example embodiment.

Some detailed example embodiment are disclosed herein. However, specific structural and functional details disclosed herein are merely representative for purposes of describing example embodiment. Example embodiment may, however, be embodied in many alternate forms and should not be construed as limited to only the example embodiment set forth herein.

Accordingly, while example embodiment are capable of various modifications and alternative forms, example embodiment thereof are shown by way of example in the drawings and will herein be described in detail. It should be understood, however, that there is no intent to limit example embodiment to the particular forms disclosed, but to the contrary, example embodiment are to cover all modifications, equivalents, and alternatives falling within the scope of example embodiment. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiment.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiment only and is not intended to be limiting of example embodiment. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements and/or groups thereof.

Example embodiment are described herein with reference to cross-sectional illustrations that are schematic illustrations of example embodiment. As such, variations from the shapes of the illustrations are to be expected. Thus, example embodiment should not be construed as limited to the shapes of regions illustrated herein but are to include deviations and variations in shapes.

When the words "about" and "substantially" are used in this specification in connection with a numerical value, it is intended that the associated numerical value include a tolerance of ±10% around the stated numerical value, unless otherwise explicitly defined. Moreover, when the terms "generally" or "substantially" are used in connection with geometric shapes, it is intended that precision of the geometric shape is not required but that latitude for the shape is within the scope of the disclosure. Furthermore, regardless of whether numerical values or shapes are modified as "about," "generally," or "substantially," it will be understood that these values and shapes should be construed as including a manufacturing or operational tolerance (e.g., ±10%) around the stated numerical values or shapes.

Unless otherwise defined, all terms (including technical and scientific terms) used herein have the same meaning as commonly understood by one of ordinary skill in the art to which example embodiment belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 1A is a schematic view of an apparatus for loading a plurality of containers with products according to at least one example embodiment.

In at least one example embodiment, as shown in FIG. 1A, an apparatus 100 for loading containers with products includes a product forming station 102, a product metering or counting station 104, a shuttle assembly 106, a container station 108, a conveyor system 110, a container loading station 112, an inspection station 114, a control interface 116, a control system 118, and a memory 120.

The product forming station is configured to form a plurality of products. In at least one example embodiment, the product forming station is configured to form a plurality of oral products.

In at least one example embodiment, the oral product is an oral tobacco product, an oral non-tobacco product, an oral cannabis product, or any combination thereof. The oral product may be in a form of loose material (e.g., loose cellulosic material), shaped material (e.g., plugs or twists), pouched material, tablets, lozenges, chews, gums, films, any other oral product, or any combination thereof.

The oral product may include chewing tobacco, snus, moist snuff tobacco, dry snuff tobacco, other smokeless tobacco and non-tobacco products for oral consumption, or any combination thereof.

Where the oral product is an oral tobacco product including smokeless tobacco product, the smokeless tobacco product may include tobacco that is whole, shredded, cut, granulated, reconstituted, cured, aged, fermented, pasteurized, or otherwise processed. Tobacco may be present as whole or portions of leaves, flowers, roots, stems, extracts (e.g., nicotine), or any combination thereof.

In at least one example embodiment, the oral product includes a tobacco extract, such as a tobacco-derived nicotine extract, and/or synthetic nicotine. The oral product may include nicotine alone or in combination with a carrier (e.g., white snus), such as a cellulosic material. The carrier may be a non-tobacco material (e.g., microcrystalline cellulose) or a tobacco material (e.g., tobacco fibers having reduced or eliminated nicotine content, which may be referred to as "exhausted tobacco plant tissue or fibers"). In some example embodiments, the exhausted tobacco plant tissue or fibers can be treated to remove at least 25%, 40%, 50%, 60%, 70%, 75%, 80%, 85%, 90%, or 95% of the nicotine. For example, the tobacco plant tissue can be washed with water or another solvent to remove the nicotine.

In other example embodiments, the oral product may include cannabis, such as cannabis plant tissue and/or cannabis extracts. In at least one example embodiment, the cannabis material includes leaf and/or flower material from one or more species of cannabis plants and/or extracts from the one or more species of cannabis plants. The one or more species of cannabis plants may include *Cannabis sativa, Cannabis indica*, and/or *Cannabis ruderalis*. In at least one example embodiment, the cannabis may be in the form of fibers. In at least one example embodiment, the cannabis may include a cannabinoid, a terpene, and/or a flavonoid. In at least one example embodiment, the cannabis material may be a cannabis-derived cannabis material, such as a cannabis-derived cannabinoid, a cannabis-derived terpene, and/or a cannabis-derived flavonoid.

The oral product (e.g., the oral tobacco product, the oral non-tobacco product, or the oral cannabis product) may have various ranges of moisture. In at least one example embodiment, the oral product is a dry oral product having a moisture content ranging from 5% by weight to 10% by weight. In at least one example embodiment, the oral product has a medium moisture content, such as a moisture content ranging from 20% by weight to 35% by weight. In at least one example embodiment, the oral product is a wet oral product having a moisture content ranging from 40% by weight to 55% by weight.

In at least one example embodiment, oral product may further include one or more elements such as a mouth-stable polymer, a mouth-soluble polymer, a sweetener (e.g., a synthetic sweetener and/or a natural sweetener), an energizing agent, a soothing agent, a focusing agent, a plasticizer, mouth-soluble fibers, an alkaloid, a mineral, a vitamin, a dietary supplement, a nutraceutical, a coloring agent, an amino acid, a chemesthetic agent, an antioxidant, a food-grade emulsifier, a pH modifier, a botanical, a tooth-whitening agent, a therapeutic agent, a processing aid, a stearate, a wax, a stabilizer, a disintegrating agent, a lubricant, a preservative, a filler, a flavorant, flavor masking agents, a bitterness receptor site blocker, a receptor site enhancers, other additives, or any combination thereof.

With continued reference to FIG. 1A, the product metering station 104 may be configured to stage a desired (or alternatively, predetermined) number of products for subsequent transfer to the shuttle assembly 106, the container loading station 112, and a plurality of containers (see e.g., container 200 of FIGS. 2A-2E). In at least one example embodiment, the product metering station 104 is configured to stage a plurality of sets of products, with each set including a desired (or alternatively, predetermined) number of products, for subsequent transfer into a respective plurality of containers.

The shuttle assembly 106 is configured to receive products from the product metering station 104 and transfer the products to a plurality of containers at the container loading station 112. In at least one example embodiment, the shuttle assembly 106 receives the products in a first shuttle position 106A. The shuttle assembly 106 transfers the products to the containers in a second shuttle position 106B at the container loading station 112.

The container station 108 is configured to deliver the containers to the conveyor system 110 for subsequent transfer to the container loading station 112. In at least one example embodiment, the container station 108 is configured to at least partially open containers prior to transferring the containers to the conveyor system 110, as described in greater detail below in the discussion accompanying FIGS. 9 and 25A-25F.

In at least one example embodiment, the container loading station 112 is configured to deposit a desired (or alternatively, predetermined) number of products into each container of a plurality of containers. The container loading station 112 is configured to receive products from the product metering station 104 via the shuttle assembly 106. The container loading station 112 is configured to receive containers from the container station 108 via the conveyor system 110.

In at least one example embodiment, for each container, the inspection station 114 is configured to determine whether the container is closed, whether the products are fully within the container, whether the container is within a desired (or alternatively, predetermined) weight range, or any combination thereof.

In at least one example embodiment, the control interface 116 may be configured to receive control commands, including commands provided by an operator based on manual interaction with the control interface 116. The control interface 116 may be a manual interface, including a touchscreen display interface, a button interface, a mouse interface, a keyboard interface, any combination thereof, or the like. Control commands received at the control interface 116 may be forwarded to the control system 118, and the control system 118 may execute one or more programs of instruction, for example to adjust operation of one or more portions of the apparatus 100, based on the control commands.

In at least one example embodiment, the control system 118 (e.g., the processor executing a program of instructions) may include the memory 120. The memory 120 may be configured to store information and look-up tables including desired (or alternatively, predetermined) values (e.g., number of containers on conveyor belt prior to operation of container loading station 112; number of products in each lane of the product metering station 104; number of attempts to partially open a container at the container station 108; weight range for a container loaded with products; and/or any other suitable values or ranges).

The control system 118 according to one or more example embodiments may be implemented using hardware, or a combination of hardware and software. Hardware may be implemented using processing or control circuitry such as, but not limited to, one or more processors, one or more Central Processing Units (CPUs), one or more microcontrollers, one or more arithmetic logic units (ALUs), one or more digital signal processors (DSPs), one or more microcomputers, one or more field programmable gate arrays (FPGAs), one or more System-on-Chips (SoCs), one or more programmable logic units (PLUS), one or more microprocessors, one or more Application Specific Integrated Circuits (ASICs), or any other device or devices capable of responding to and executing instructions in a defined manner.

For example, when a hardware device is a computer processing device (e.g., a processor, Central Processing Unit (CPU), a controller, an arithmetic logic unit (ALU), a digital signal processor, a microcomputer, a microprocessor, etc.), the computer processing device may be configured to carry out program code by performing arithmetical, logical, and input/output operations, according to the program code. Once the program code is loaded into a computer processing device, the computer processing device may be programmed to perform (e.g., execute) the program code, thereby transforming the computer processing device into a special purpose computer processing device. In a more specific example, when the program code is loaded into a processor, the processor becomes programmed to perform the program code and operations corresponding thereto, thereby transforming the processor into a special purpose processor.

According to one or more example embodiments, computer processing devices may be described as including various functional units that perform various operations and/or functions to increase the clarity of the description. However, computer processing devices are not intended to be limited to these functional units. For example, in one or more example embodiments, the various operations and/or functions of the functional units may be performed by other ones of the functional units. Further, the computer processing devices may perform the operations and/or functions of the various functional units without sub-dividing the operations and/or functions of the computer processing units into these various functional units.

Units and/or devices according to one or more example embodiments may also include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiment described herein. The computer programs, program code, instructions, or some combination thereof, may also be loaded from a separate computer readable storage medium into the one or more storage devices and/or one or more computer processing devices using a drive mechanism. Such separate computer readable storage medium may include a Universal Serial Bus (USB) flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The one or more hardware devices, the one or more storage devices, and/or the computer programs, program code, instructions, or some combination thereof, may be specially designed and constructed for the purposes of the example embodiment, or they may be known devices that are altered and/or modified for the purposes of example embodiment.

A hardware device, such as a computer processing device, may run an operating system (OS) and one or more software applications that run on the OS. The computer processing device also may access, store, manipulate, process, and create data in response to execution of the software. For simplicity, one or more example embodiments may be exemplified as one computer processing device; however, one skilled in the art will appreciate that a hardware device may include multiple processing elements and multiple types of processing elements. For example, a hardware device may include multiple processors or a processor and a controller. In addition, other processing configurations are possible, such as parallel processors.

Software may include a computer program, program code, instructions, or some combination thereof, for independently or collectively instructing or configuring a hardware device to operate as desired. The computer program and/or program code may include program or computer-readable instructions, software modules, data files, data structures, and/or the like, capable of being implemented by one or more hardware devices, such as one or more of the hardware devices mentioned above. Examples of program code include both machine code produced by a compiler and higher level program code that is executed using an interpreter.

Software and/or data may be embodied permanently or temporarily in any type of machine, element, physical or virtual equipment, or computer storage medium or device, capable of providing instructions or data to, or being interpreted by, a hardware device. The software also may be distributed over network coupled computer systems so that the software is stored and executed in a distributed fashion. In particular, for example, software and data may be stored by one or more computer readable recording mediums, including the tangible or non-transitory computer-readable storage media or memory 120 discussed herein.

Figure 1B:
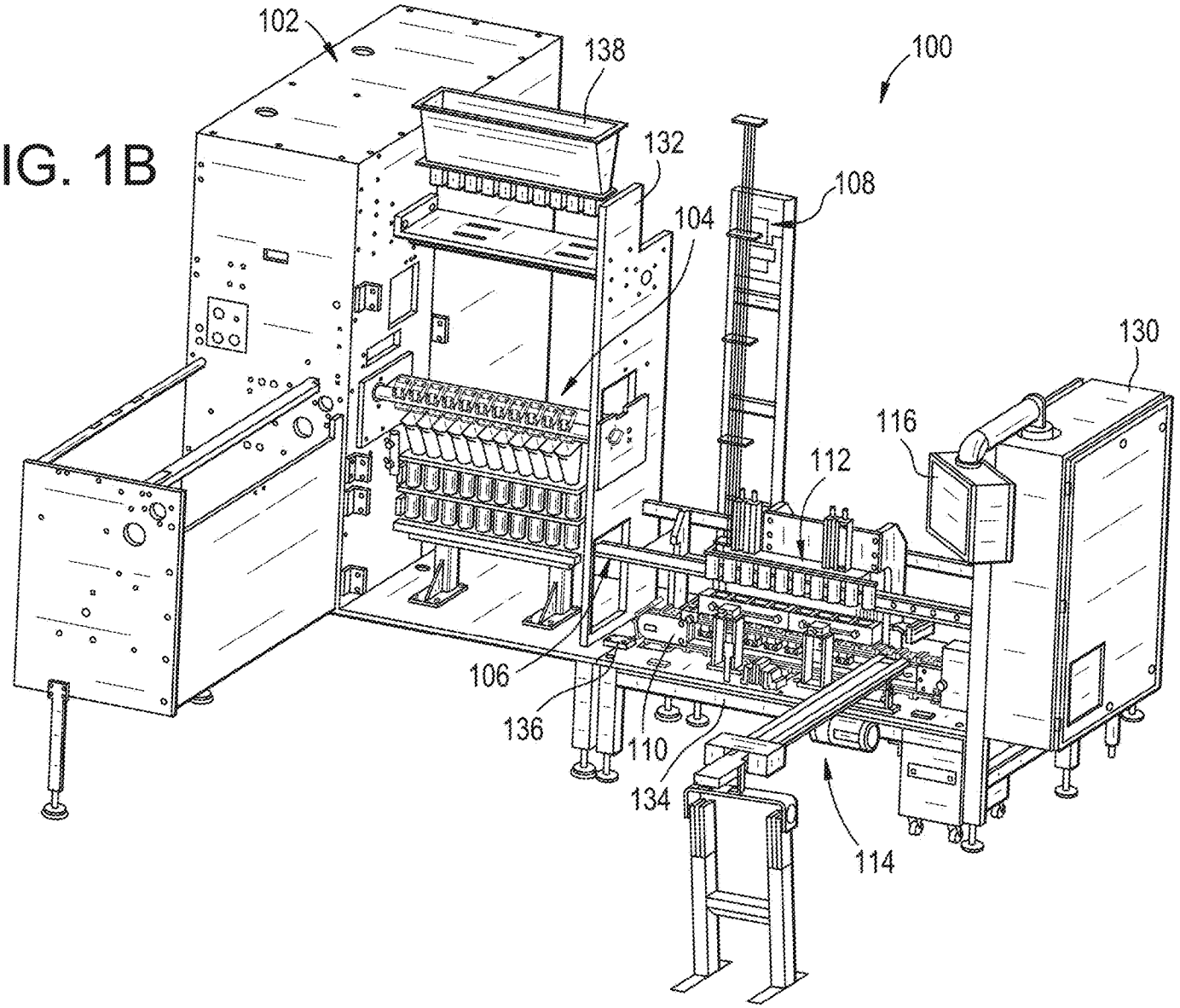

FIG. 1B is a perspective view of the apparatus of FIG. 1A according to at least one example embodiment.

In at least one example embodiment, as shown in FIG. 1B, the apparatus includes the product forming station 102, the product metering station 104, the shuttle assembly 106, the container station 108, the conveyor system 110, the container loading station 112, the inspection station 114, the control interface 116, such as a human machine interface (HMI), and an electrical enclosure 130 that houses the control system 118 (shown in FIG. 1A) and the memory 120 (shown in FIG. 1A).

The apparatus 100 includes a first frame 132 and a second frame 134. The first frame 132 houses at least a portion of the apparatus 100 and the second frame 134 houses at least another portion of the apparatus 100. The first and second frames 132, 134 may be coupled and/or aligned by tie bars 136. In at least one other example embodiment, the apparatus 100 includes a single frame. In at least one other example embodiment, the apparatus 100 includes more than two frames that are optionally coupled to one another.

In at least one example embodiment, the first frame 132 houses the product forming station 102 and the product metering station 104. The second frame 134 houses the container station 108, the conveyor system 110, the container loading station 112, and the inspection station 114. While not shown, the apparatus 100 may include different or additional housings, covers, or shields, such as to reduce or prevent dust migration into elements of the apparatus 100.

In at least one example embodiment, the product forming station 102 may include a hopper 138 configured to deliver formed products to the product metering station 104. The product forming station 102 may be any suitable product forming station, such as the pouch maker described in U.S. Pat. No. 10,399,712 to Longest et. al (filed Dec. 29, 2014), which is incorporated herein by reference hereto. Any other suitable product forming station may be used.

Figure 2A:
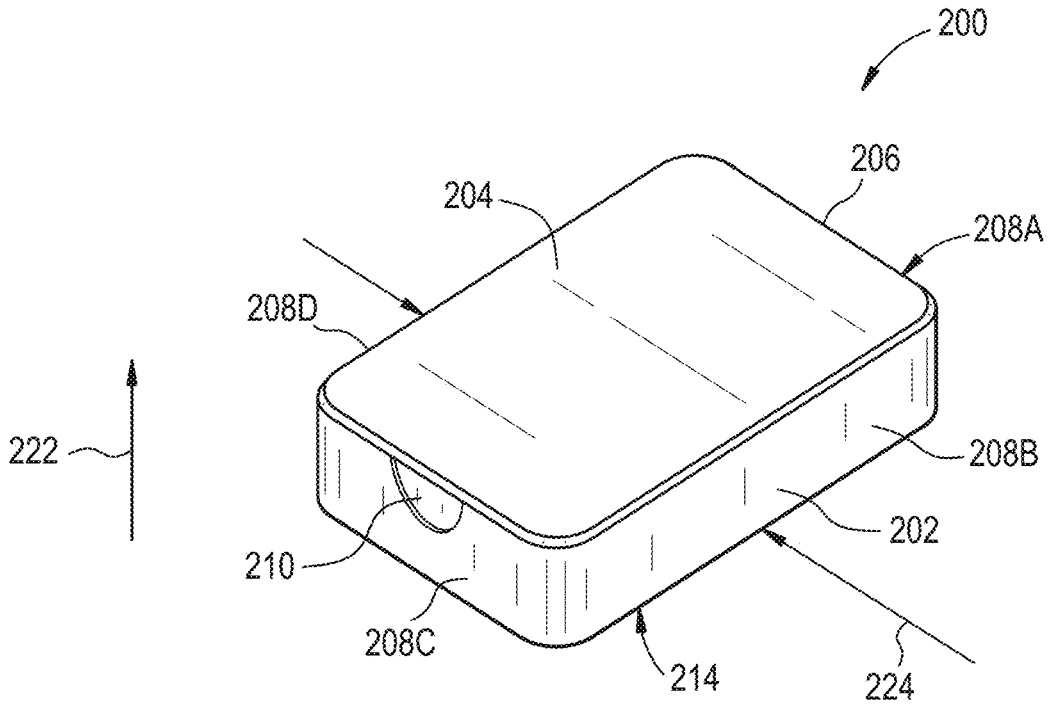
FIGS. 2A-2E depict a container for use with the apparatus of FIGS. 1A-1B according to at least one example embodiment.
Figure 2B:
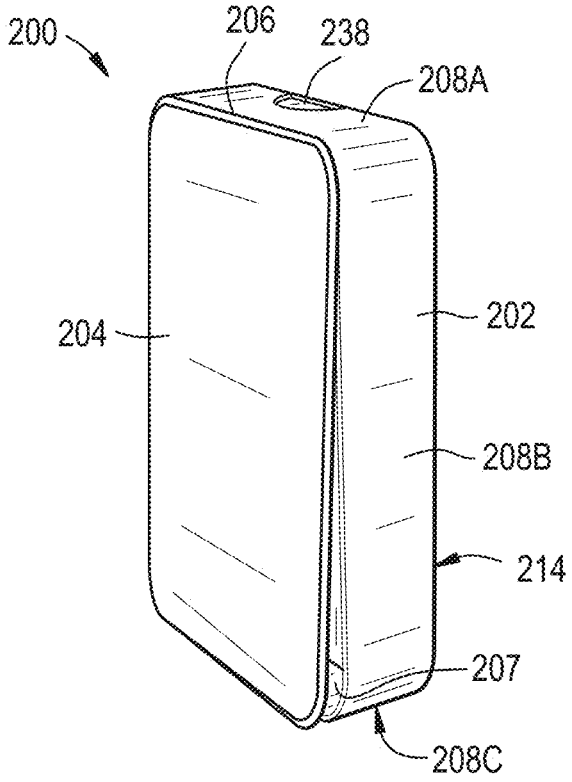
Figure 2C:
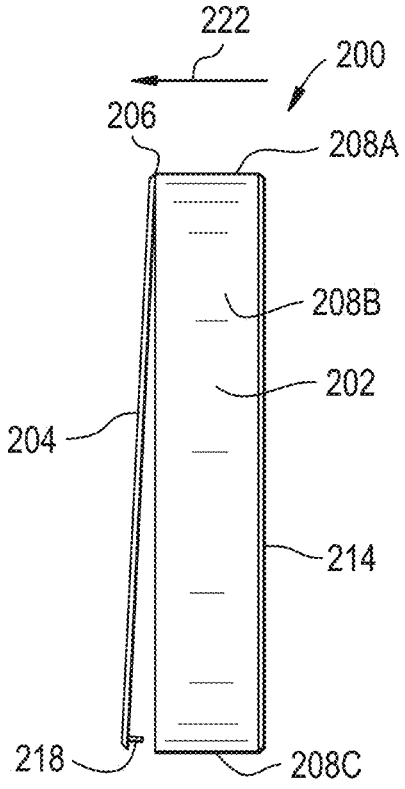
Figure 2D:
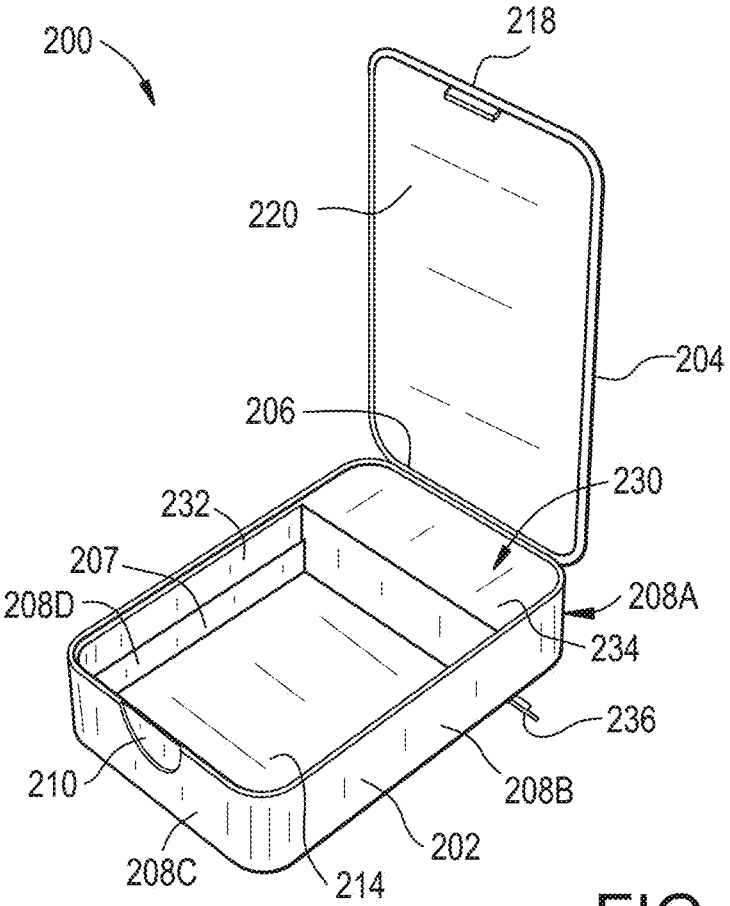
Figure 2E:
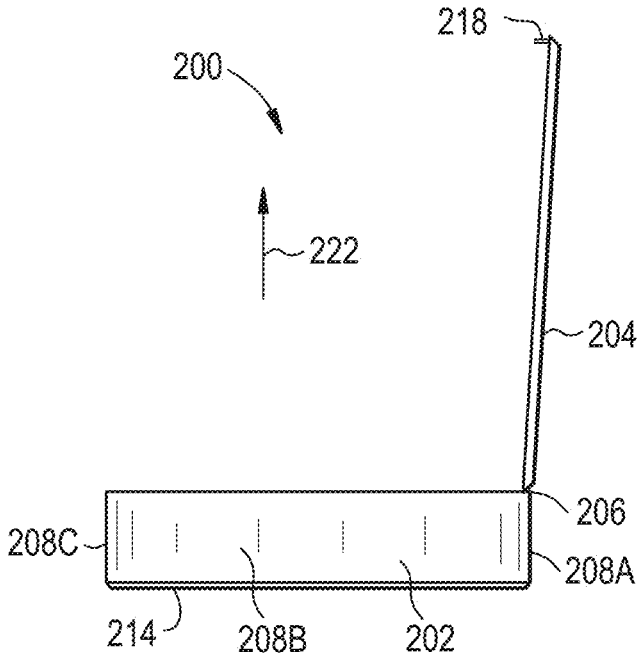

FIGS. 2A-2E depict a container for use with the apparatus of FIGS. 1A-1B according to at least one example embodiment. FIG. 2A is a perspective view of the container in a closed position. FIG. 2B is a perspective view of the container in a partially open position. FIG. 2C is a side view of the container in the partially open position. FIG. 2D is a perspective view of the container in a fully open position. FIG. 2E is a side view of the container in the fully open position.

In at least one example embodiment, as shown in FIGS. 2A-2E, a container 200 includes a container base 202 and a lid 204. The lid 204 may be pivotally attached to the container base 202 at a hinge adjacent to an edge 206.

In at least one example embodiment, the container 200 is movable between a closed position (shown in FIG. 2A), a partially open position (shown in FIGS. 2B-2C), and a fully open position (shown in FIGS. 2D-2E). In the closed position, the lid 204 of the container 200 is locked, latched, snapped, or otherwise engaged with the container base 202. In a partially open position, the lid 204 is at least partially disengaged from the container base 202, such as unlocked, unlatched, unsnapped, or otherwise at least partially disengaged from the container base 202. In at least one example embodiment, in the partially open position, the lid 204 reduces or prevents access to an interior region 207 (shown in FIG. 2D) of the container base 202. In the fully open position, the lid 204 is at least partially spaced apart from the container base 202 such that the container base 202 is configured to receive products.

The container base 202 may include a bottom wall and one or more side walls 208. In at least one example embodiment, the container base 202 includes a first side wall 208A, a second side wall 208B, a third side wall 208C, and a fourth side wall 208D. The second side wall 208B may extend between the first and third side walls 208A, 208C and be opposite the fourth side wall 208D. The fourth side wall 208D may extend between the first and third side walls 208A, 208C.

The hinge may be adjacent to the first side wall 208A such that the lid 204 is pivotally connected to the first side wall 208A. The third side wall 208C may be opposite the first side wall 208A. The lid 204 may be configured to be removably coupled to the third side wall 208C. The third side wall 208C may define a first scallop or depression 210. The first scallop 210 may define a substantially semicircular shape with its straight edge configured to be adjacent to the lid 204.

The container 200 may include a floor 214 extending between the first, second, third, and fourth side walls 208A, 208B, 208C, 208D. The floor 214 and the first, second, third, and fourth side walls 208A, 208B, 208C, 208D may cooperate to define the interior region 207 (shown in FIG. 2D). The interior region 207 may be configured to receive products.

In at least one example embodiment, the lid 204 includes a latch 218 (shown in FIGS. 2C-2E). The latch 218 may extend from an inside surface 220 of the lid 204. When the container 200 is in the closed position, the latch 218 may be configured to be at least partially within the interior region 207. The latch 218 may be configured to engage the third side wall 208C to retain the container 200 in the closed position. In at least one example embodiment, the container 200 may be transitioned into the partially open position or the fully open position by applying a force to the lid 204 in a first container direction 222 substantially parallel with a height of the container 200 and/or pinching the container 200 as shown at 224 (shown in FIG. 2A) to disengage the third side wall 208C from the latch 218.

In at least one example embodiment, the container 200 further includes an insert 230. The insert 230 may be least partially within the interior region 207 of the container base 202. The insert 230 may include an insert frame 232 and an insert compartment 234. The insert frame 232 may extend around at least a portion of a perimeter of the interior region 207. The insert frame 232 may engage the second, third, and fourth side walls 208B, 208C, 208D of the container base 202.

The insert compartment 234 may be accessible by a compartment door 236 that is pivotally coupled to the container base 202. In at least one example embodiment, the interior region 207 is configured to contain oral pouch products and the insert compartment 234 is configured to contain spent pouches. When the insert compartment 234 is closed, the compartment door 236 may be substantially coplanar with the floor 214 of the container base 202. The compartment door 236 may include a compartment latch (not shown) that may be similar to the latch 218 on the lid 204 to retain the compartment 234 in a closed position. In at least one example embodiment, the first side wall 208A may define a second scallop or depression 238 (shown in FIG. 2B) adjacent to the compartment door 236. The second scallop 238 may define a substantially semi-circular shape having a straight edge configured to be adjacent to the compartment door 236.

Figure 3A:
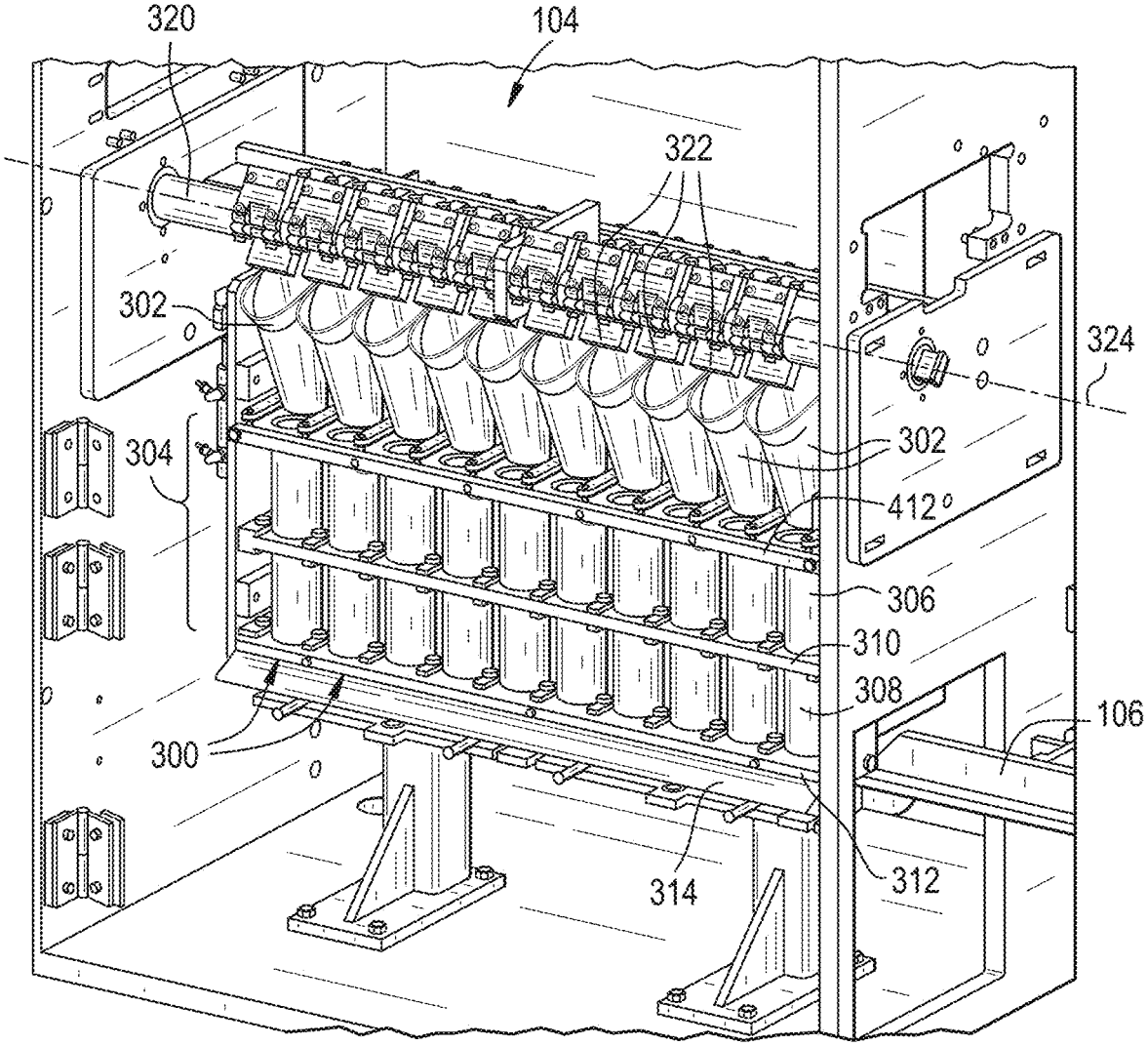
FIGS. 3A-3B are a partial perspective views of a product metering station of the apparatus of FIGS. 1A-1B according to at least one example embodiment.
Figure 3B:
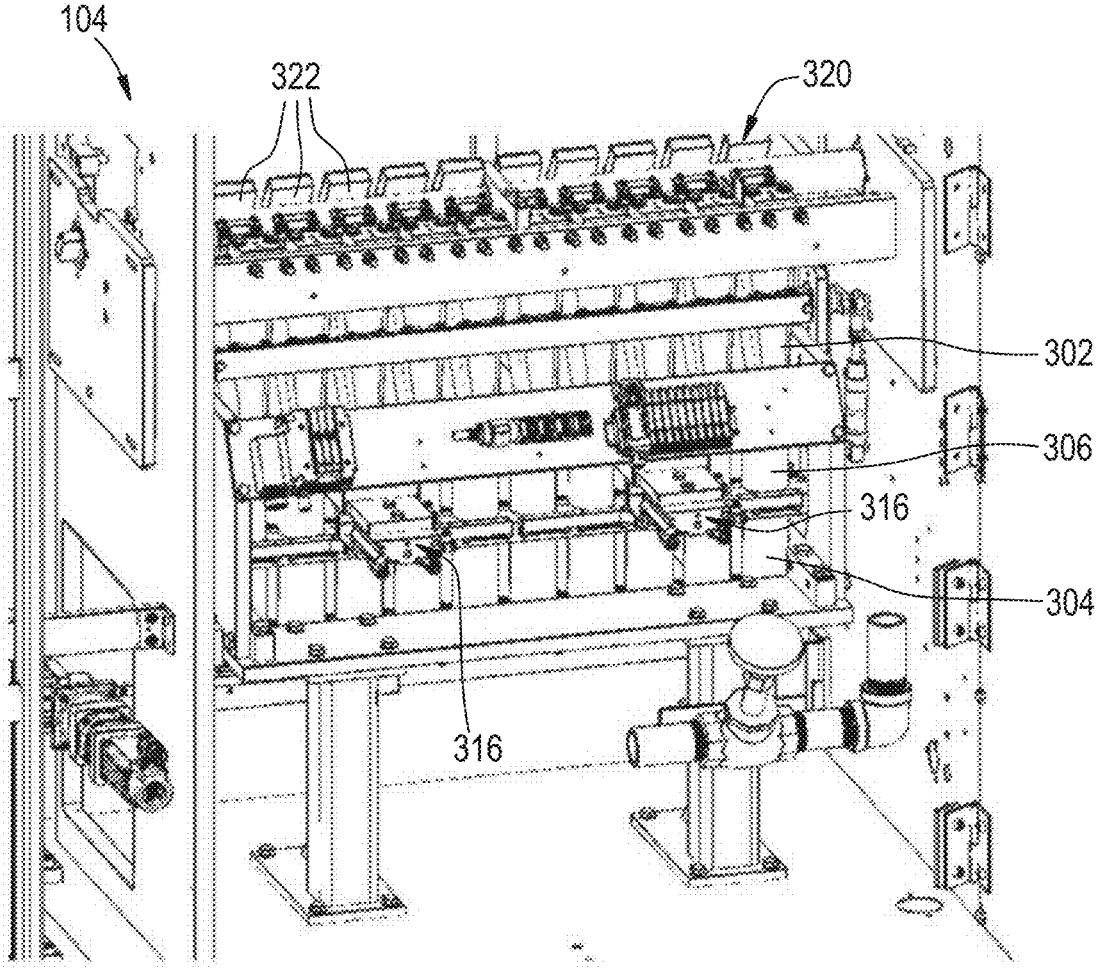
Figure 4:
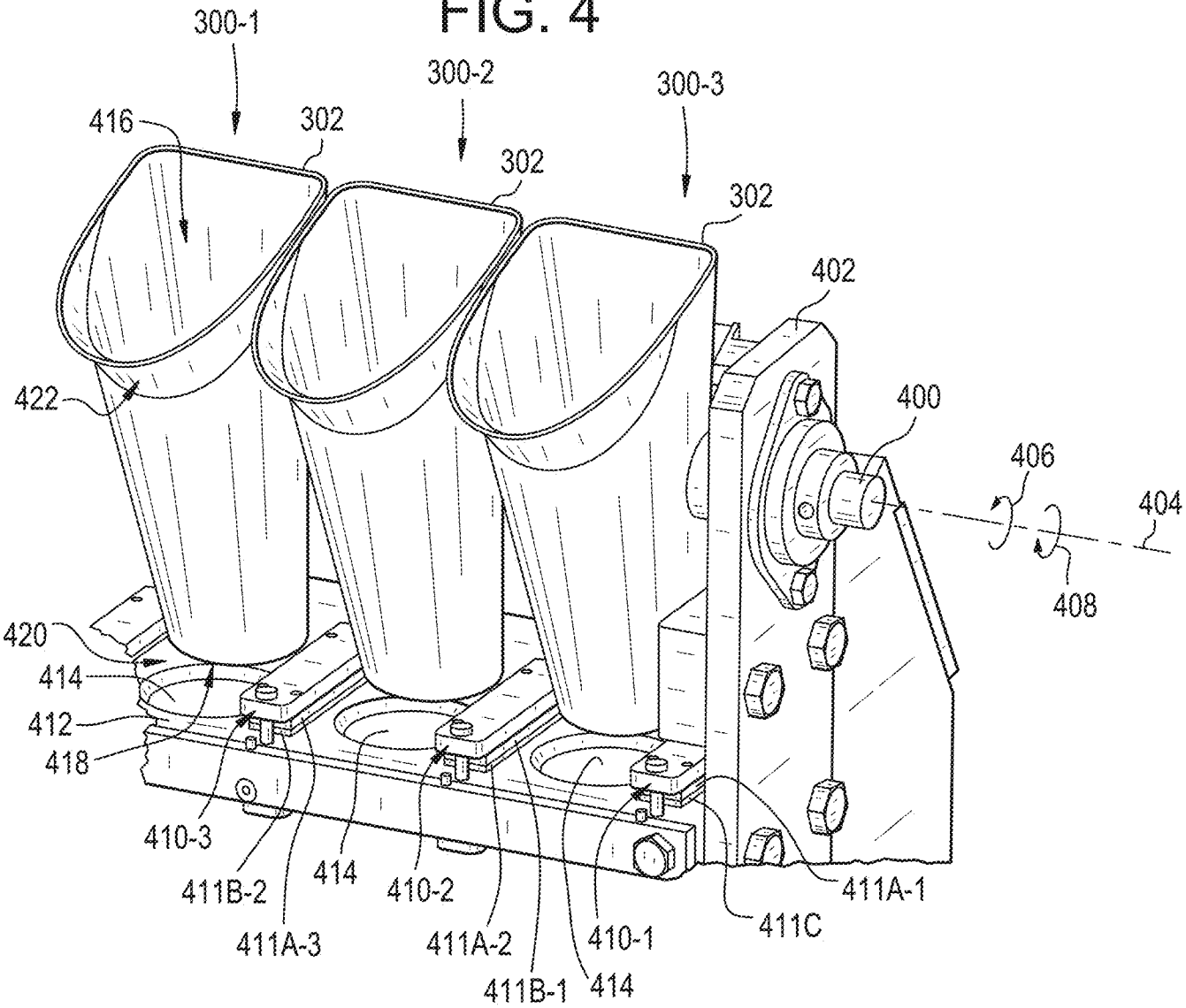
FIG. 4 is a partial perspective view of diverter chutes of the product metering station of FIG. 3A according to at least one example embodiment.
Figure 5:
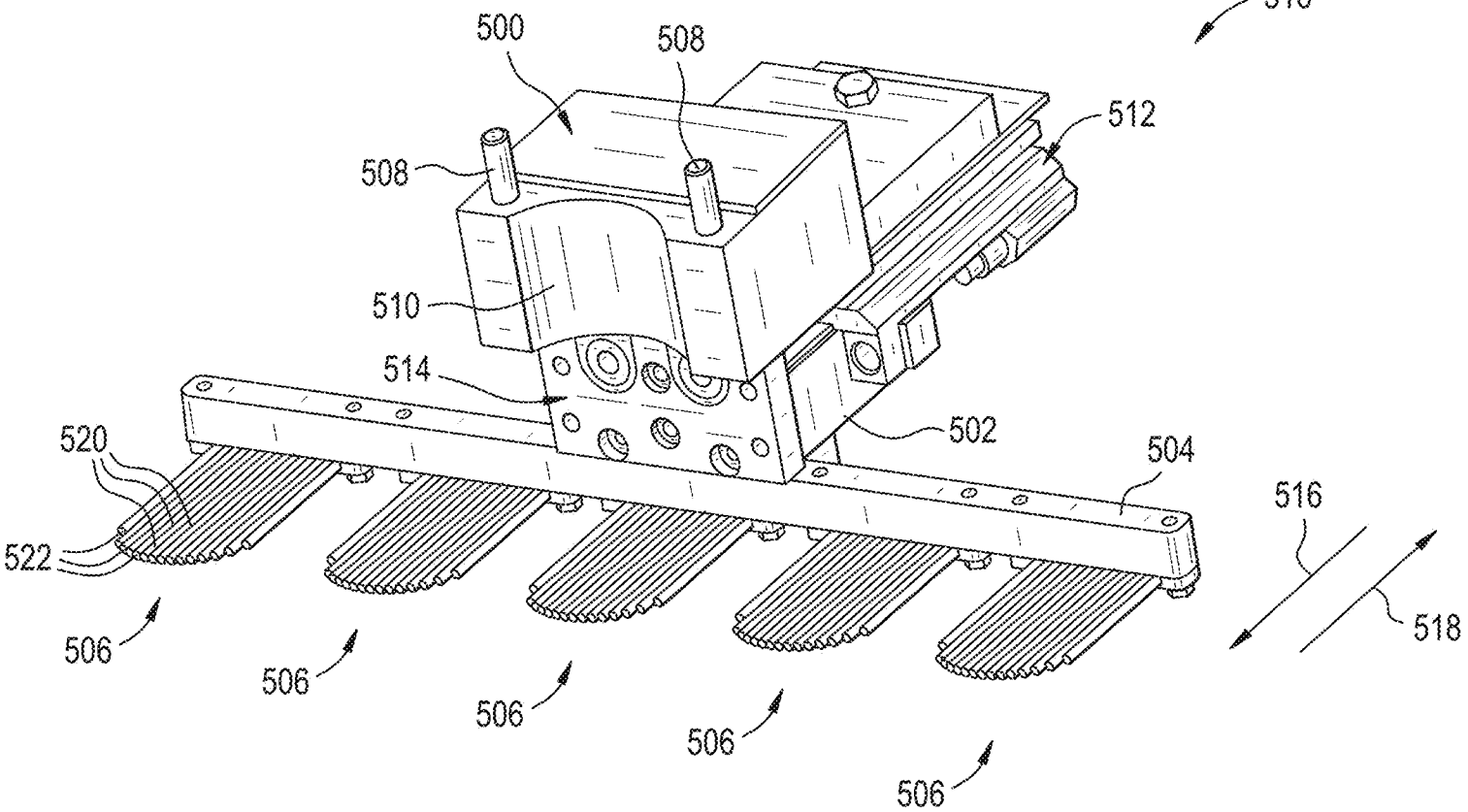
FIG. 5 is a perspective view of a filling gate assembly of FIG. 3B according to at least one example embodiment.

FIG. 3A is a front partial perspective view of a product metering station of the apparatus of FIGS. 1A-1B according to at least one example embodiment. FIG. 3B is a back partial perspective view of the product metering station of FIG. 3A according to at least one example embodiment. FIG. 4 is a partial perspective view of diverter chutes and sensors of the product metering station of FIG. 3A according to at least one example embodiment. FIG. 5 is a perspective view of the gate assembly of FIG. 3B according to at least one example embodiment.

Referring to FIG. 3A, in at least one example embodiment, the product metering station 104 includes a plurality of lanes 300. Each of the lanes 300 is configured to receive and collect a respective sets of products. In at least one example embodiment, the product metering station 104 includes ten lanes, each configured to collect a set of products (e.g., 10 products) for a total of ten sets of products. The sets of products may subsequently be transferred into respective containers of plurality (e.g., 10) of containers at the container loading station 112 (shown in FIGS. 1A-1B) via the shuttle assembly 106.

In at least one example embodiment, each lane 300 includes a diverter chute 302 and a filling tube or passage 304. Each of the diverter chutes 302 is configured to receive a plurality of products from the product forming station 102 (shown in FIG. 1B). In at least one example embodiment, each diverter chute 302 is configured to receive products from a respective funnel (not shown).

The diverter chutes 302 are movable between a first chute position and a second chute position. In the first chute position, as shown in FIG. 3A, the diverter chutes 302 are configured to transfer the products into the respective filling tubes 304. In the second chute position (not shown), the diverter chutes 302 are configured to transfer the products into a reject or sample bin (not shown). In at least one example embodiment, each lane 300 includes a respective reject bin below the diverter chute (not shown).

Referring to FIG. 4, in at least one example embodiment, the diverter chutes 302 are coupled to a diverter shaft 400. The diverter shaft 400 may be supported between a pair of side mounting plates 402. The diverter shaft 400 may be configured to pivot the diverter chutes 302 about a pivot axis 404 from the first chute position, as shown, to the second chute position. The diverter shaft 400 is configured pivot in a first rotational direction 406 to pivot the diverter chutes 302 from the first chute position to the second chute position. The diverter shaft 400 is configured to pivot in a second rotational direction 408 opposite the first rotational direction 406 to pivot the diverter chutes 302 from the second chute position to the first chute position.

In at least one example embodiment, the diverter chutes 302 are configured to move together between the first and second chute positions. In at least one other example embodiment, the diverter chutes 302 are configured to be independently movable between the first and second chute positions. The pivoting of the diverter chutes 302 between the first and second chute positions may be performed manually or may be automated (e.g., with an actuator controlled by the control system 118).

In at least one example embodiment, the product metering station 104 includes a plurality of sensor assemblies 410. The sensor assemblies 410 may be between each of the diverter chutes 302. Each sensor assembly 410 may include one or more transmitters 411A (shown as 411A-1, 411A-2, 411-3), one or more receivers 411B (shown as 411B-1, 411B-2), and one or more spacer blocks 411C. Collectively, a pair of one of the sensor transmitters 411A and one of the sensor receivers 411B may be referred to as a first sensor 411.

In at least one example embodiment, the sensor assemblies 410 cooperate to house a plurality of first sensors, as described below. The first sensors may be light sensors, such as fiber-optic sensors, laser sensors, photoelectric sensors, color sensors, another type of light sensor, a non-light sensor, or any combination thereof. The transmitters 411A are configured to emit light. In at least one example embodiment, the light may be emitted in a plurality of substantially parallel and coplanar beams. All or a portion of the light not being received at the receiver 411B may indicate that the light is being blocked by a product, and therefore, that the product may have traveled between the diverter chute 302 and the filling tube 304.

In at least one example embodiment, each of the lanes 300 includes one of the sensor transmitter 411A and a corresponding one of the sensor receiver 411B configured to sense whether products are transferred into the filling tubes 304 by the diverter chutes 302. In the example shown, a first lane 300-1 includes a first transmitter 411A-1 and a first receiver 411B-1. A second lane 300-2 includes a second transmitter 411A-2 and a second receiver 411B-2. A third lane 300-3 includes a third transmitter 411A-3 and a third receiver (not shown). The first transmitter 411A-1 and the spacer block 411C may be housed in a first sensor assembly 410-1. The first receiver 411B-1 and the second transmitter 411A-2 may be housed in a second sensor assembly 410-2. The second receiver 411B-2 and the third transmitter 411A-3 may be housed in a third sensor assembly 410-3. While not shown, the sensor assemblies 410 may instead alternatingly house two transmitters or two receivers.

In at least one example embodiment, the sensor assemblies 410 are coupled to an upper filling plate 412. The upper filling plate 412 is between the diverter chutes 302 and the filling tubes 304. The upper filling plate 412 may define a plurality of upper apertures 414 through which the products may be transferred. While the upper apertures 414 are shown as substantially circular, the example embodiments are not limited thereto.

In at least one example embodiment, each diverter chute 302 defines a funnel shape that is tapered between a first or upper end 416 and a second or lower end 418. The upper end 416 may have a larger transverse dimension than the lower end 418. Accordingly, the diverter chutes 302 may receive products within the larger upper end 416 and precisely deliver the products via the smaller lower end 418, past a sensing region defined between two sensor assemblies 410, through the upper aperture 414, and into the filling tube 304. In at least one example embodiment, the upper end 416 of each of the diverter chutes 302 includes a outwardly-flared portion 422. While the diverter chutes 302 are shown as having tapered shapes, the example embodiments are not limited thereto.

Returning to FIG. 3A, in at least one example embodiment, each of the filling tubes 304 may include a first or upper filling tube 306 and a second or lower filling tube 308. Each of the upper filling tubes 306 may extend between the upper filling plate 412 and a middle filling plate 310. Each of the lower filling tubes 308 may extend between the middle filling plate 310 and a lower filling plate 312. The middle filling plate 310 includes a plurality of middle apertures (see, e.g., middle aperture 2402 of FIGS. 24A-24E) corresponding to the respective plurality of lanes 300 to permit transfer of products from the upper filling tubes 306 to the lower filling tubes 308. While the filling tubes 304 are shown as cylindrical two part (i.e., upper and lower filling tubes 306, 308), the example embodiments are not limited thereto.

Referring to FIG. 3B, in at least one example embodiment, one or more filling gate assemblies 316 are between the upper filling tubes 306 and the lower filling tubes 308. At least a portion of each of the filling gate assemblies 316 is configured to move between a first filling gate position and a second filling gate position. In the first filling gate position, a portion of the gate assembly is between the upper filling tubes 306 and the lower filling tubes 308 to reduce or inhibit products from passing through the middle apertures (see, e.g., middle aperture 2402 of FIGS. 24A-24E) of the middle filling plate 310. In the second filling gate position, the filling gate assembly 316 is at least partially outside of the middle apertures so that products may pass through the middle apertures.

Referring to FIG. 5, in at least one example embodiment, the product metering station 104 includes one or more of the filling gate assemblies 316. Each of the filling gate assemblies 316 includes an alignment portion 500, a slider 502, a gate bar 504, and a plurality of filling gates 506. The filling gate assembly 316 is located adjacent to the upper filling plate 412 via pegs 508. The alignment portion 500 defines a depression 510 in which one of the upper filling tubes 306 (shown in FIG. 3B) is at least partially disposed. Accordingly, the depression 510 may define a portion of a cylindrical shape.

The slider 502 may include a fixed portion 512 and a movable portion 514. The movable portion 514 is configured to translate with respect to the fixed portion 512. The movable portion 514 may translate in a first filling gate direction 516 (e.g., horizontal and forward) between the second filling gate position and the first filling gate position, such as by a linear actuator controlled by the control system 118. The movable portion 514 may translate in a second filling gate direction 518 (e.g., horizontal and backward) opposite the first filling gate direction 516 between the first filling gate position and the second filling gate position.

The gate bar 504 is coupled to the movable portion 514 of the slider 502 and configured to move together with the movable portion 514 of the slider 502. The filling gates 506 are coupled to the gate bar 504 and configured to move together with the gate bar 504 and the movable portion 514 of the slider 502. In at least one example embodiment, the filling gate assembly 316 includes a plurality of discrete filling gates 506. Each filling gate 506 may correspond to a lane 300 (shown in FIG. 3A). In at least one other example embodiment, a gate assembly includes one or more gates each configured to correspond to multiple lanes 300, such as a single elongated gate that corresponds to five lanes 300.

In at least one example embodiment, each filling gate 506 includes a plurality of tines 520. The tines 520 may be spaced apart from one another to define gaps such that the filling gate 506 is air permeable. However, the gaps between tines 520 may be small enough to reduce and/or prevent products from falling through the gaps. The tines 520 may extend substantially perpendicular to the gate bar 504. The tines 520 may cooperate to define a substantially planar structure. Distal ends 522 of the tines 520 may cooperate to define a partially-circular edge profile of the filling gate 506. In at least one other example embodiment, a gate may include and/or define a different or additional structure, such as a mesh, a perforated sheet, a solid sheet, or any other suitable solid or apertured structure.

When the filling gate assembly 316 is in the first filling gate position, the filling gates 506 are at least partially disposed between a respective pair of upper and lower filling tubes 306, 308 (shown in FIG. 3B). When the filling gate assembly 316 is in the second filling gate position, the filling gates 506 are at least partially outside of a space between the upper and lower filling tubes 306, 308 to permit products to be transferred from the upper filling tube 306 to the lower filling tube 308. A method according to at least one example embodiment is described in greater detail below in relation to the discussion of FIGS. 24A-24E.

Returning to FIG. 3A, the product metering station 104 may include a metering device 320. In at least one example embodiment, as shown, the metering device 320 is a rotary knife. The metering device 320 may include a plurality of knives or blades 322. The metering device 320 may be configured to rotate about a metering axis 324. In at least one example embodiment, the metering device 320 is configured to rotate continuously without stopping between products or batches of products.

In at least one example embodiment, the products are pouch products and the metering device 320 is configured to cut individual products from a tube of multiple products. In at least one example embodiment, each incremental rotation of the metering device 320 (e.g., a full rotation of 360°, a half rotation of 180°, or a quarter rotation of 90°) corresponds to one product being transferred (e.g., dropped) into one of the diverter chutes 302. Accordingly, products may be counted based on incremental rotations of the metering device 320.

In at least one example embodiment, the product metering station 104 includes a shield 314 coupled to the lower filling plate 312. The shield 314 may be configured to reduce or prevent interference of products and/or debris with the shuttle assembly 106 in the first shuttle position 106A (shown in FIGS. 1A-1B). In at least one example embodiment, the product metering station 104 may further include a second shield (not shown) coupled to the middle filling plate 310.

Figure 6:
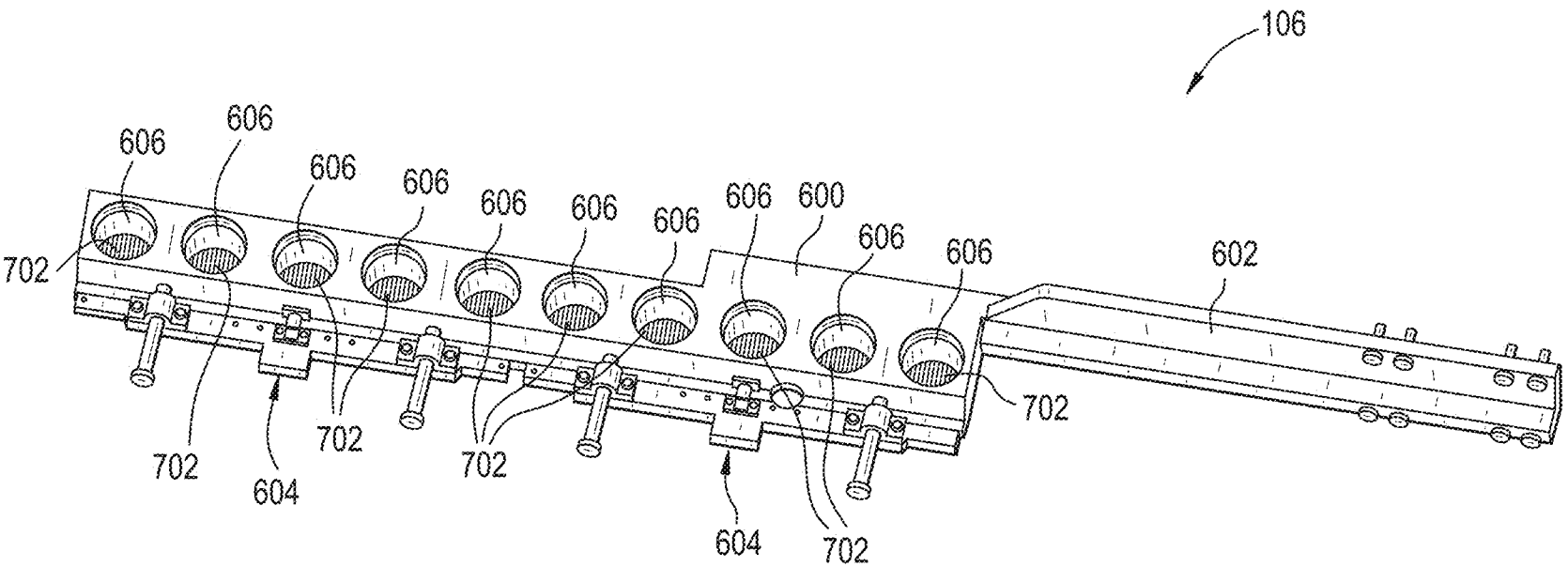
FIG. 6 is a perspective view of a shuttle assembly of the apparatus of FIGS. 1A-1B according to at least one example embodiment.

FIG. 6 is a perspective view of a shuttle assembly of the apparatus of FIGS. 1A-1B according to at least one example embodiment.

In at least one example embodiment, as shown in FIG. 6, the shuttle assembly 106 includes a body 600, a mounting arm 602, and one or more shuttle gate assembles 604. In at least one example embodiment, the shuttle assembly 106 includes two shuttle gate assemblies 604. The mounting arm 602 is configured to be coupled to a linear actuator (not shown) driven by a servo motor (not shown) to move the shuttle assembly 106 between the first shuttle position 106A (shown in FIGS. 1A-1B) and the second shuttle position (shown in FIGS. 1A-1B). The linear actuator and servo motor are configured to be controlled by the control system 118 (shown in FIGS. 1A-1B).

The body 600 defines a plurality of product apertures or receptacles 606. A number of product apertures 606 may correspond to a number of lanes 300 (shown in FIG. 3A) in the product metering station 104 (shown in FIG. 3A). While the product apertures 606 are shown as defining substantially cylindrical shapes, the example embodiments are not limited thereto.

Figure 7:
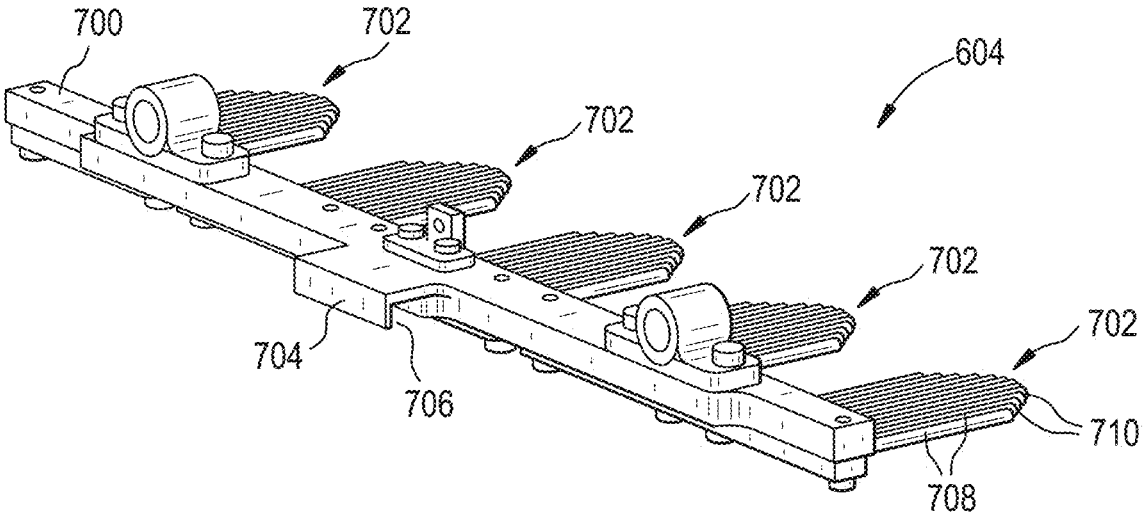
FIG. 7 is a perspective view of a shuttle gate assembly of the shuttle assembly of FIG. 6 according to at least one example embodiment.

FIG. 7 is a perspective view of a gate assembly of the shuttle assembly of FIG. 6 according to at least one example embodiment.

In at least one example embodiment, each of the shuttle gate assemblies 604 includes a gate bar 700, a plurality of shuttle gates 702, and a handle 704. The gate bar 700 may define an elongated shape. Each of the shuttle gates 702 may be coupled to the gate bar 700. The handle 704 may extend from the gate bar 700. In at least one example embodiment, the handle 704 is integrally formed with at least a portion of the gate bar 700. The handle 704 may at least partially define a receptacle 706, such as a channel or slot. The receptacle 706 may be configured to receive a protrusion or other engagement feature (see, e.g., gate puller 2004 of FIG. 20).

In at least one example embodiment, each shuttle gate 702 includes a plurality of tines 708. The tines 708 may be spaced apart from one another to define gaps such that the shuttle gate 702 is air permeable. However, the gaps between tines 708 may be small enough to reduce and/or prevent product from falling through the gaps. The tines 708 may extend substantially perpendicular to the gate bar 700. The tines 708 may cooperate to define a substantially planar structure. Distal ends 710 of the tines 708 may cooperate to define a partially-circular edge profile. In at least one other example embodiment, a gate may define and/or include a different or additional structure, such as a mesh, a perforated sheet, a solid sheet, or any other suitable solid or apertured structure.

Returning to FIG. 6, the shuttle gate assembly 604 may be movable with respect to the body 600. In at least one example embodiment, the shuttle gate assembly 604 is configured to be translated between a first shuttle gate position, as shown, and a second shuttle gate position. The shuttle gate assembly 604 may be configured to be moved between the first and second shuttle gate positions by a linear actuator controlled by the control system 118 (shown in FIGS. 1A-1B), as will be described in greater detail in the discussion accompanying FIGS. 26E-26G.

In the first shuttle gate position, as shown, the shuttle gates 702 may be at least partially disposed within the apertures 606, such that the tines 708 at least partially extend into the apertures 606. The shuttle gate 702 may extend transversely across at least a portion of the aperture 608. The shuttle gates 702 may be configured to reduce and/or prevent product from passing (e.g., falling) through the product apertures 606. In at least one example embodiment, the tines 708 may be disposed at least partially within the body 600. The body 600 may define a plurality of tine apertures (not shown) into which the tines 708 are at least partially disposed. Accordingly, the shuttle gates 702 may be disposed at an intermediate location with respect to a height of the product apertures 606 (e.g., parallel to a longitudinal axis of a cylindrical product aperture). In at least one other example embodiment, the shuttle gates 702 are at least partially disposed within slots defined in the body 600 (e.g., one slot per gate). In at least one other example embodiment, the shuttle gates 702 are disposed completely on one side of the body 600, such as an underside of the body 600.

In a second shuttle gate position, the shuttle gates 702 may be at least partially outside of the respective apertures 606. Accordingly, in the second shuttle gate position, the apertures 606 may form passages to allow product to pass through the apertures 606.

Returning to FIG. 1B, the shuttle assembly 106 in the first shuttle position 106A (shown in FIG. 1A) is configured to receive products from the product metering station 104. The shuttle assembly 106 is configured to be translated to the second shuttle position 106B (shown in FIG. 1A) at the container loading station 112. The container loading station 112 is configured to receive containers from the container station 108.

Figure 8:
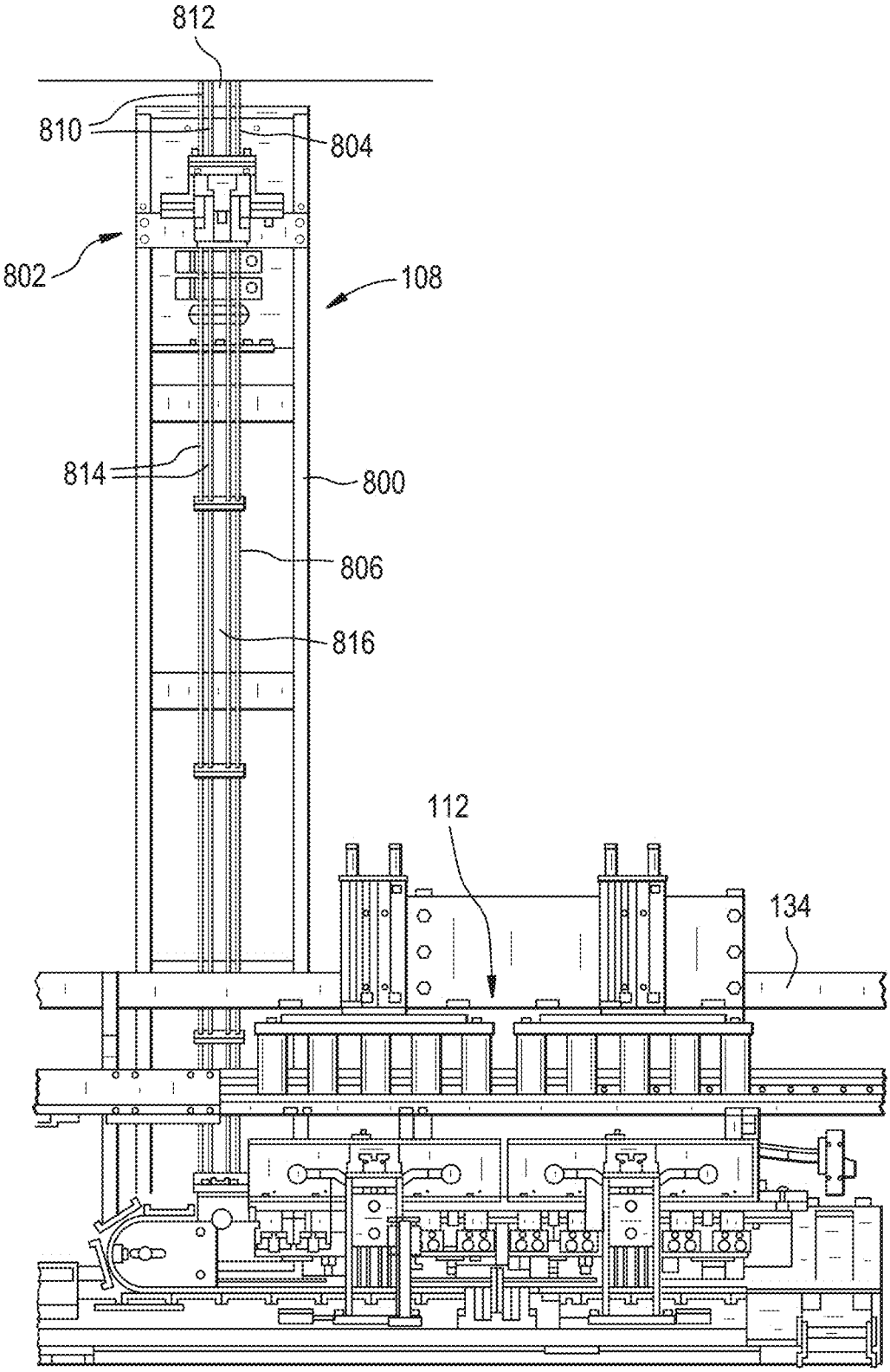
FIG. 8 is a side view of a container station and container loading station of the apparatus of FIGS. 1A-1B according to at least one example embodiment.

FIG. 8 is a side view of a container station of the apparatus of FIGS. 1A-1B according to at least one example embodiment.

In at least one example embodiment, as shown in FIG. 8, the container station 108 includes a support 800, a pre-opening assembly 802, a receiving chute 804, and a transfer chute 806. The support 800 may be coupled to the second frame 134. The pre-opening assembly 802, the receiving chute 804, and the transfer chute 806 may be coupled to the support 800. In at least one example embodiment, the pre-opening assembly 802 is configured to sequentially receive containers from the receiving chute 804.

In at least one example embodiment, the receiving chute 804 may include a plurality of receiving wires 810 that cooperate to define a receiving passage 812. In at least one other example embodiment, the receiving chute 804 may include additional or alternative structures, such as one or more rails, one or more channels, a tube, and or any other structure configured to deliver containers to the pre-opening assembly 802.

Figure 9:
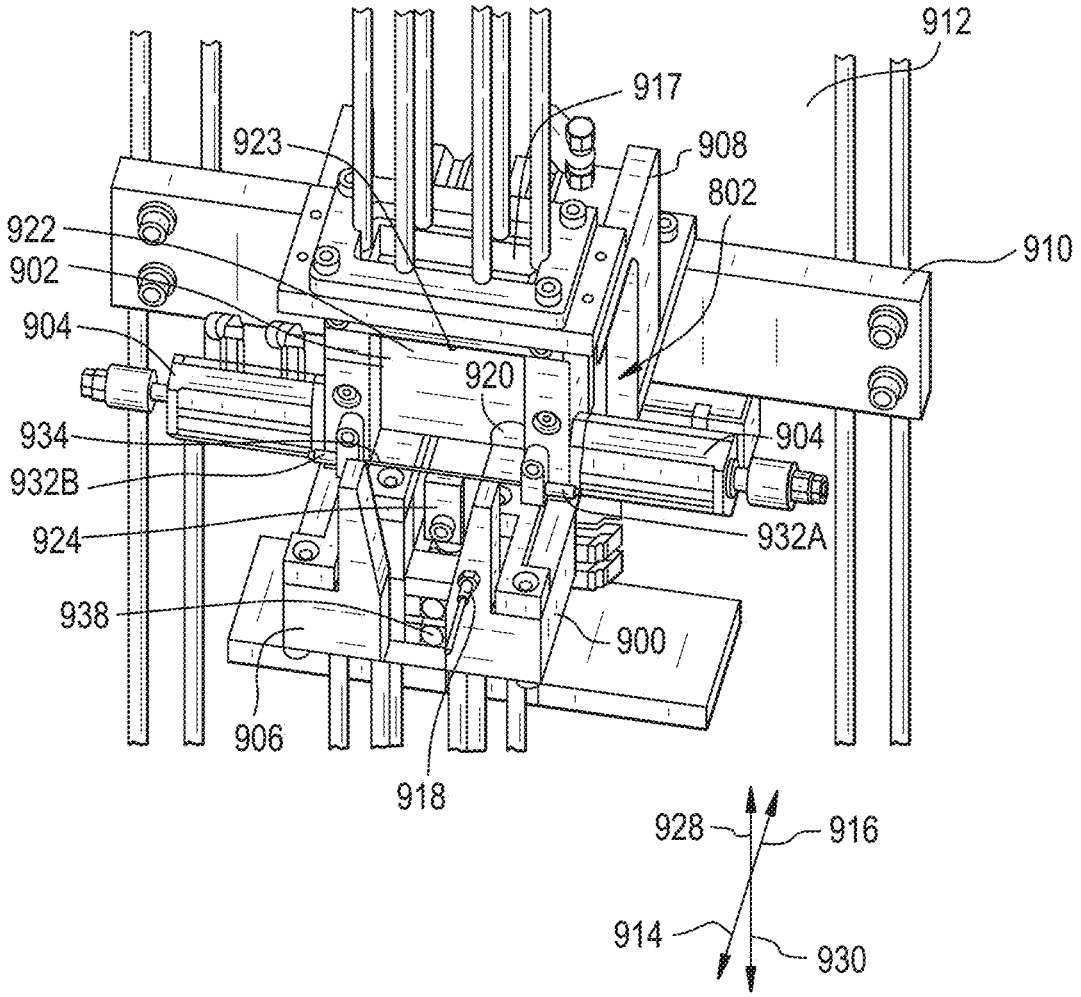
FIG. 9 is a partial perspective view of a pre-opening assembly of the container station of FIG. 8 according to at least one example embodiment.

FIG. 9 is a partial perspective view of a container opening assembly of the container station of FIG. 8 according to at least one example embodiment.

In at least one example embodiment, as shown in FIG. 9, the pre-opening assembly 802 includes a base 900, a nest 902, one or more pinchers 904, and a stop 906. The base 900 may include a pair of side supports 908. The pair of side supports 908 may be coupled to a transverse bar 910. The transverse bar 910 may be coupled to a plate 912 configured to couple the pre-opening assembly 802 to the support 800 (shown in FIG. 8).

In at least one example embodiment, the nest 902 is configured to be movable with respect to the base 900. The nest 902 may be translatable between a first nest position, as shown, and a second nest position, such as by a linear actuator (not shown) controlled by the control system 118 (shown in FIG. 1A). In the first nest position, the nest may be aligned (e.g., vertically) with the receiving chute 804. The nest 902 may be configured to translate in a first opener direction 914 (e.g., horizontally and forward) from the first nest position to the second nest position. The nest 902 may be configured to translate in a second opener direction 916 (e.g., horizontally and backward) opposite the first opener direction 914 from the second nest position to the first nest position.

In the first nest position, the nest 902 may be configured to receive a container from the receiving chute 804. The nest 902 may be configured to receive containers through a receiving opening 917. In at least one example embodiment, the receiving chute 804 is configured to drop (e.g., by gravity feed) containers through the receiving opening and into the nest 902.

In at least one example embodiment, the pre-opening assembly 802 includes a second sensor 918 and a reflector 920. The second sensor 918 may be mounted to the stop 906. The reflector 920 may be on a wall 922 of the nest 902. A data signal from the second sensor 918 may be configured to indicate whether a container is present in the nest 902.

In at least one example embodiment, the second sensor 918 is a light sensor, such as a fiber-optic sensor, a laser sensor, a photoelectric sensor, a color sensor, another type of light sensor, a non-light sensor, or any combination thereof. The second sensor 918 may house a transmitter (not shown) and a receiver (not shown). The transmitter of the second sensor 918 is configured to emit light, such as in a beam, that travels toward the reflector 920. Receipt of light by the receiver of the second sensor 918 may indicate that the light traveled to the reflector 920 and was reflected back to the second sensor 918, indicating that a container has not been received in the nest 902. All or a portion of the light not being returned to the receiver of the second sensor 918 may indicate that a container has been received in the nest 902. While the reflector 920 is shown, the example embodiments are not limited thereto. In at least one example embodiment, the pre-opening assembly 802 is free of a reflector and the sensor 918 is configured to reflect light from the container.

In at least one example embodiment, the wall 922 defines a vacuum aperture 923. The vacuum aperture 923 is configured to receive vacuum pressure to retain and/or stabilize a container in the nest 902.

The pinchers 904 may be configured to pinch a container while the container is in the nest 902. In at least one example embodiment, the pre-opening assembly 802 includes two pinchers 904. At least a portion of each of the pinchers 904 may be configured to move toward the other of the pinchers 904 to pinch or squeeze the container between the pinchers 904.

Figure 10:
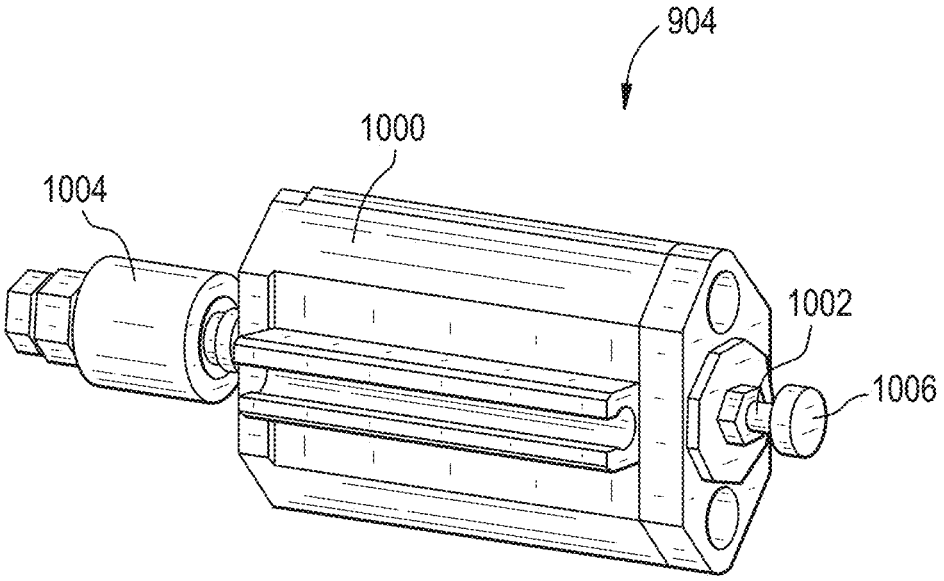
FIG. 10 is a perspective view of a pincher of the container pre-opening assembly of FIG. 9 according to at least one example embodiment.

FIG. 10 is a perspective view of a pincher of the container opening assembly of FIG. 9 according to at least one example embodiment.

In at least one example embodiment, as shown in FIG. 10, each of the pinchers 904 is a cylinder. Each pincher 904 may include a pincher body 1000, a pincher rod 1002, and a stopper 1004. The pincher body 1000 may be coupled to a respective side support 908 (shown in FIG. 9). The pincher rod 1002 may be movable with respect to the pincher body 1000, such as by a hydraulic piston or a pneumatic piston. The gripper rod 1002 may be translated between a pinch position and a retracted position. In the pinch position, a head 1006 of the pincher rod 1002 is configured to engage the container. As shown, the head 1006 may have a greater diameter than the rod. While the head 1006 is shown as cylindrical, the example embodiments are not limited thereto. The pincher 904 may be configured to deform the container in the pinch position. In the retracted position, the head 1006 may be configured to be disengaged from the container. An amount of translation may be set by adjusting a position of the stopper 1004.

Returning to FIG. 9, in at least one example embodiment, the pre-opening assembly includes a blade 924. The blade 924 may be coupled to the base 900. The blade 924 may be configured to be movable with respect to the base 900. The blade 924 may be translated between a first blade position and a second blade position, as shown, such as by a linear actuator.

In the first blade position, the blade 924 is configured to engage a container to at least partially open the container (e.g., unlock or unlatch a lid from a container base). The blade 924 may be configured to at least partially open the container when the container is pinched between the pinchers 904. In the second blade position, as shown, the blade 924 is configured to be disengaged from the container. The blade 924 may be moved in a third opener direction 928 (e.g., vertically upward) from the second blade position to the first blade position. The blade 924 may be moved in a fourth opener direction 930 (e.g., vertically downward) opposite the third opener direction 928 from the first blade position to the second blade position.

In at least one example embodiment, the pre-opening assembly 802 includes a third sensor 932 (shown as 932A, 932B, collectively) including a transmitter 932A and a receiver 932B. In at least one example embodiment, positions of the transmitter 932A and the receiver 932B may be swapped. The third sensor 932 may be configured to determine whether a container has been at least partially opened, such as when the lid enters a space between the transmitter 932A and receiver 932B.

In at least one example embodiment, the third sensor 932 is a light sensor, such as a fiber-optic sensor, a laser sensor, a photoelectric sensor, a color sensor, another type of light sensor, a non-light sensor, or any combination thereof. The third sensor 932 is configured to emit light 934 from the transmitter 932A. All or a portion of the light 934 not being received at the receiver 932B may indicate that the light 934 is being blocked by a container lid, and therefore that the container has been transitioned from the closed position to the partially-open position. In at least one example embodiment, the light may be emitted in a form of a beam.

The nest 902 may be configured to be moved from the first nest position to the second nest position, such as when the container has been at least partially opened. In the second position, the nest 902 is configured to transfer the container through a transfer opening 938 and into the transfer chute 806, such as by gravity.

Returning to FIG. 8, in at least one example embodiment, the transfer chute 806 includes a plurality of transfer wires 814 that cooperate to define a transfer passage 816. In at least one other example embodiment, the transfer chute 806 may include additional or alternative structures, such one or more rails, one or more channels, a tube, and or any other structure configured to receive containers from the pre-opening assembly 802 and deliver containers to the container loading station 112 (shown in FIGS. 1A-1B). In at least one example embodiment, the transfer chute 806 includes one or more level sensors (not shown) configured to generate a data signal indicating a quantity of containers within the transfer chute 806. The level sensors may be light sensors, such as fiber-optic sensors, laser sensors, photoelectric sensors, color sensors, another type of light sensor, a non-light sensor, or any combination thereof. In at least one example embodiment, the transfer passage 816 is substantially linear. In at least one other example embodiment, the transfer passage 816 defines a non-linear path, such as a serpentine path (see. e.g., serpentine channel 1104 of FIG. 11).

Figure 11:
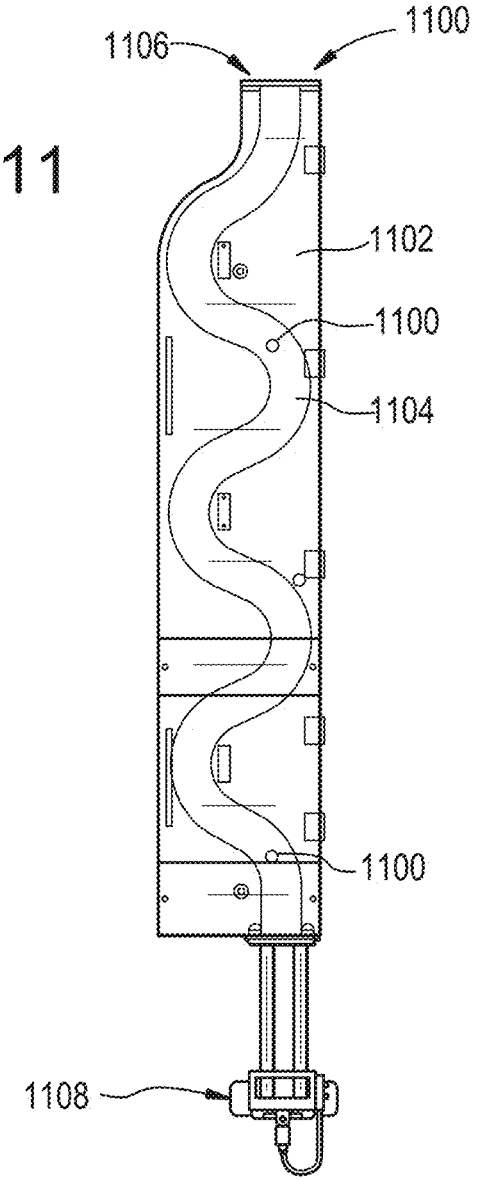
FIG. 11 is a partial side view of a transfer chute of another container station of another apparatus according to at least one example embodiment.

FIG. 11 is a partial side view of a transfer chute of another container station of an apparatus according to at least one example embodiment.

In at least one example embodiment, as shown in FIG. 11, another transfer chute 1100 includes a body 1102. The body defines a serpentine channel or transfer passage 1104. Compared to the linear transfer passage 816 of FIG. 8, the serpentine transfer passage 1104 may be configured to transfer containers more slowly, such as under the influence of gravity. Accordingly, the serpentine transfer passage 1104 may be configured to reduce (compared to a linear transfer passage) or prevent opening of the containers.

The transfer chute 1100 may be configured to receive containers from a pre-opening assembly (e.g., the pre-opening assembly 802 of FIG. 8) at a first end 1106. The transfer chute 1100 may be configured to deliver containers to the conveyor system 110 (shown in FIGS. 1A-1B) at a second end 1108.

In at least one example embodiment, the transfer chute 1100 includes one or more level sensors (not shown). The level sensors may be light sensors, such as fiber-optic sensors, laser sensors, photoelectric sensors, color sensors, another type of light sensor, a non-light sensor, or any combination thereof. In at least one example embodiment, the transfer chute 1100 includes one or more photoelectric reflective sensors, each disposed adjacent to an aperture 1110 in the body. A signal from each level sensor may be configured to indicate whether containers are present in the serpentine track adjacent (e.g., at least partially covering) the respective aperture 1110.

Returning to FIG. 8, the transfer chute 806 may be configured to deliver containers to the conveyor system 110.

Figure 12:
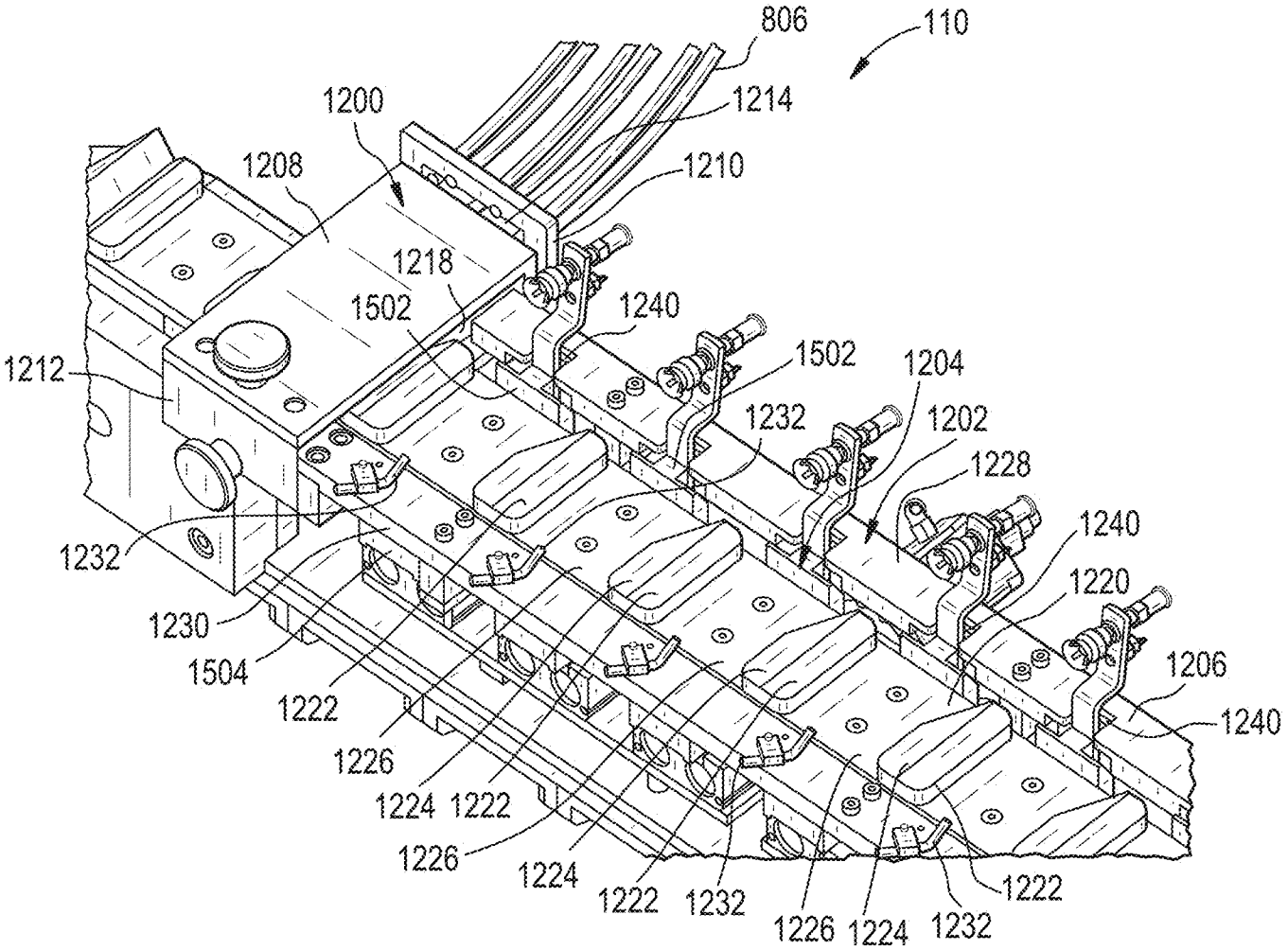
FIG. 12 is a partial perspective view of a conveyor system of the apparatus of FIGS. 1A-1B according to at least one example embodiment.

FIG. 12 is a partial perspective view of a conveyor system of the apparatus of FIG. 1A-1B according to at least one example embodiment.

In at least one example embodiment, the conveyor system 110 includes a garage assembly 1200, a conveyor assembly 1202, one or more gripper and shaker assemblies 1204, and a conveyor support 1206. The garage assembly 1200 may be configured to sequentially receive containers from the transfer chute 806.

The garage assembly 1200 may include cover 1208, a first end wall 1210, and a second end wall 1212. The first end wall 1210 may define a garage opening 1214 through which containers may pass. The cover 1208 may be configured to reduce and/or prevent the containers from fully opening while in the garage assembly 1200.

Figure 13:
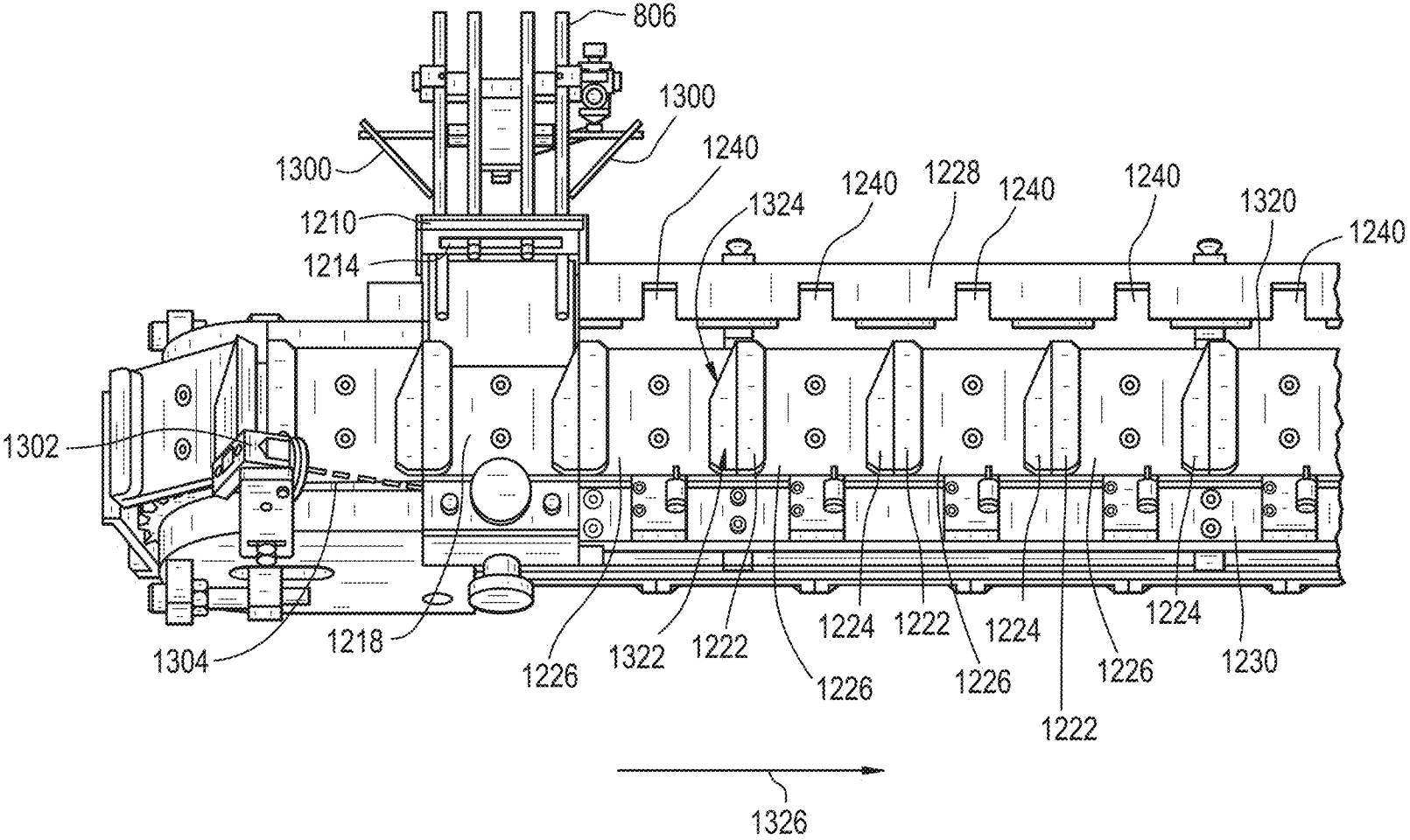
FIG. 13 is a partial top view of the conveyor system of FIG. 12 having a garage cover removed according to at least one example embodiment.

FIG. 13 is a partial top view of the conveyor system of FIG. 12 having a garage cover removed according to at least one example embodiment.

In at least one example embodiment, one or more chute nozzles 1300 may be coupled to the transfer chute 806 and/or the garage assembly 1200. The chute nozzles 1300 may be configured to direct a fluid, such as air, at containers to facilitate transfer of the containers from the transfer chute 806 to the garage assembly 1200.

A fourth sensor 1302 may be directed toward an interior of the garage assembly 1200. A signal 1304 from the fourth sensor 1302 may be configured to indicate whether a container is fully seated on the conveyor assembly 1202. The fourth sensor 1302 may be a light sensor, such as fiber-optic sensor, a laser sensor, a photoelectric sensor, a color sensor, a another type of light sensor, a non-light sensor, or any combination thereof. In at least one example embodiment, the fourth sensor 1302 is a photoelectric laser sensor. The fourth sensor 1302 may include a transmitter and receiver in a single housing. The transmitter may be configured to emit a laser beam. The laser beam may be configured to reflect off of a container and return to the receiver when a container is present in the garage assembly 1200.

In at least one example embodiment, the conveyor assembly 1202 includes a conveyor belt 1220. The conveyor belt 1220 is configured to receive containers from the transfer chute 806 and deliver the containers to the container loading station 112 (shown in FIGS. 1A-1B). The conveyor belt 1220 includes a plurality of first conveyor walls (or cleats) 1222 and a plurality of second conveyor walls 1224. The first and second conveyor walls 1222, 1224 may be separate, or each first conveyor wall 1222 may cooperate with a respective second conveyor wall 1224 to form a unitary body. Each of the first conveyor walls 1222 cooperates with a respective second conveyor wall 1224 to define a pocket 1226. The pockets 1226 are configured to receive containers.

Returning to FIG. 13, in at least one example embodiment, the first conveyor walls 1222 extend substantially perpendicular to an edge 1320 of the conveyor belt 1220. The second conveyor walls 1224 include a first portion 1322 that extends substantially perpendicular to the edge 1320 and a second portion or ramp 1324 that defines an oblique angle with respect to the edge 1320. The ramp 1324 facilitates receipt and alignment of a container within the pocket 1226.

The conveyor belt 1220 may be configured to move the containers in a conveyance direction 1326. The conveyor belt 1220 may be driven by a servo motor (see servo motor 2140 of FIGS. 21A-21B) controlled by the control system 118 (shown in FIG. 1A). The conveyor belt 1220 may be moved intermittently, each time a container is seated on the conveyor belt 1220 within the garage assembly 1200 (shown in FIG. 12), until a desired (or alternatively, predetermined) number of containers have been received by the conveyor belt 1220. In at least one example embodiment, the conveyor belt 1220 is configured to remain substantially stationary until a container has been properly seated, as determined by a signal from the fourth sensor 1302.

Returning to FIG. 12, the conveyor support 1206 may include a proximal rail 1228 and a distal rail 1230. The proximal and distal rails 1228, 1230 may extend substantially parallel to one another. The conveyor belt 1220 is between the proximal and distal rails 1228, 1230.

In at least one example embodiment, the conveyor system 110 includes a plurality of first air nozzles 1232. The first air nozzles 1232 may be coupled to the distal rail 1230. The first air nozzles 1232 may be configured to direct a flow of fluid (e.g., air) at lids of the containers to facilitate moving the containers from a partially open position to a fully open position.

Figure 14:
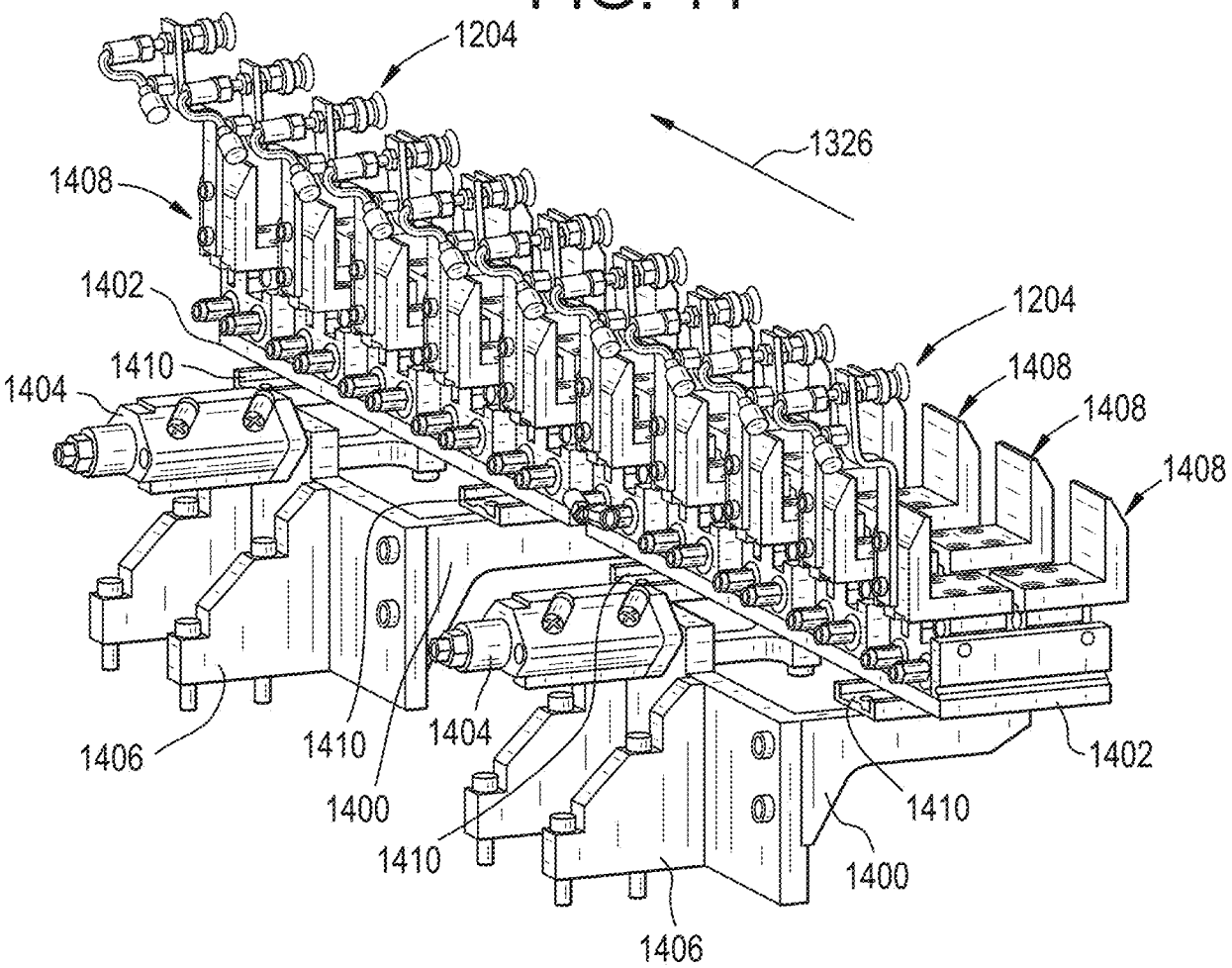
FIG. 14 is a perspective view of gripper and shaker assemblies of the conveyor system of FIG. 12 according to at least one example embodiment.

FIG. 14 is a perspective view of gripper and shaker assemblies of the conveyor system 110 of FIG. 12 according to at least one example embodiment.

In at least one example embodiment, as shown in FIG. 14, the gripper and shaker assemblies 1204 may be at least partially underneath the conveyor assembly 1202 of FIG. 12. Each of the gripper and shaker assemblies 1204 includes a shaker support 1400, a gripper support 1402, a shaker cylinder 1404, a cylinder mount 1406, and a plurality of gripper assemblies 1408. The shaker cylinder 1404 may be coupled to the cylinder mount 1406. A portion of the shaker cylinder 1404 may be fixed with respect to the cylinder mount 1406. The shaker support 1400 may be coupled to the cylinder mount 1406. The shaker support 1400 may be fixed with respect to the cylinder mount 1406.

One or more bearings 1410, such as two bearings 1410, may be coupled to the shaker support 1400. The bearings 1410 may be fixed with respect to the shaker support 1400. The gripper support 1402 may be slidingly coupled to the bearings 1410. Therefore, the gripper support 1402 and gripper assemblies 1408 may be movable with respect to the shaker support 1400. The shaker cylinder 1404 may be coupled to the gripper support 1402 and configured to move or shake the gripper support 1402, such as by a pneumatic or hydraulic piston.

Figure 15:
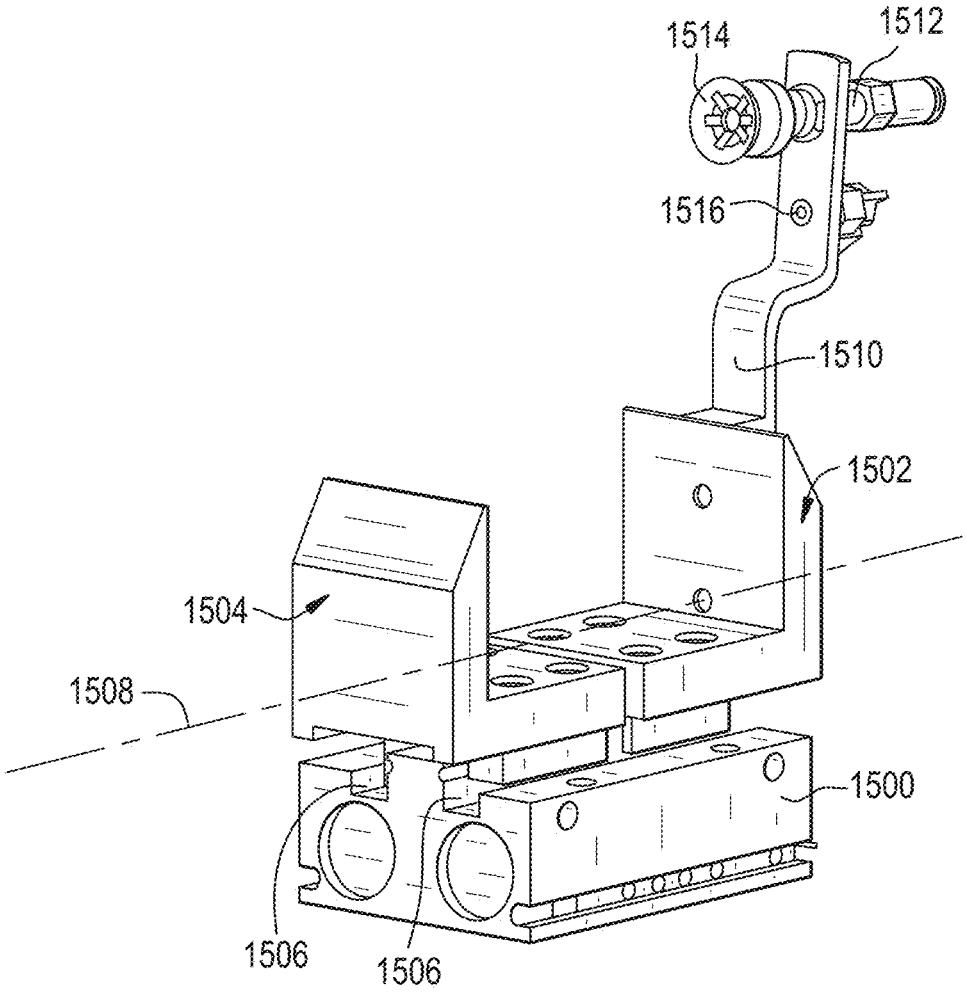
FIG. 15 is a perspective view of a gripper assembly of the gripper and shaker assembly of FIG. 14 according to at least one example embodiment.

FIG. 15 is a perspective view of a gripper assembly of the gripper and shaker assembly of FIG. 14 according to at least one example embodiment.

In at least one example embodiment, each gripper assembly includes a gripper base 1500, a first clamping portion 1502, and a second clamping portion 1504. The gripper base 1500 may define one or more gripper channels 1506. The first and second clamping portions 1502, 1504 may be slidingly disposed in the gripper channels 1506.

At least one of the first clamping portion 1502 and the second clamping portion 1504 may be configured to be movable with respect to the gripper base 1500 and the other of the first clamping portion 1502 and the second clamping portion 1504. The first and second clamping portions 1502, 1504 are translatable between a clamping position and a separated position, such as by one or more linear actuators (not shown).

In the clamping position, the first and second clamping portions 1502, 1504 are configured to engage a container. In the separated position, the first and second clamping portions 1502, 1504 are configured to be disengaged from the container. The gripper assembly 1408 may be configured to move from the separated position to the clamping position by translating one or both of the first and second clamping portions 1502, 1504 toward one another along a gripping axis 1508. The gripper assembly 1408 may be configured to move from the clamping position to the separated position by translating one or both of the first and second clamping portions 1502, 1504 away from one another along the gripping axis 1508.

In at least one example embodiment, the gripper assembly 1408 further includes an arm 1510 extending from the first clamping portion 1502. The gripper assembly 1408 may include a vacuum nozzle 1512 and suction cup 1514. The vacuum nozzle 1512 and suction cup 1514 may be configured to receive and engage a container lid when the container is in the fully open position.

In at least one example embodiment, the gripper assembly 1408 includes a second air nozzle 1516. The second air nozzle 1516 may be configured to direct a fluid (e.g., air) at a lid of a container in an open position to move the container to the partially open position.

Returning to FIG. 12, in at least one example embodiment, the proximal rail defines a plurality of slots 1240. Each of the arms 1510 of the gripper and shaker assembly 1204 may extend at least partially through a respective slot 1240. Accordingly, the vacuum nozzles 1512 and respective suction cups 1514 may be configured to capture a lid that is fully opened by the first air nozzles 1232. The first and second clamping portions 1502, 1504 may extend on opposing sides of the conveyor belt 1220 and be configured to clamp a container that is on the conveyor belt 1220.

Returning to FIGS. 1A-1B, the container loading station 112 may be configured to receive containers from the conveyor system 110 and products from the shuttle assembly 106 in the second shuttle position 106B (shown in FIG. 1A). In the second shuttle position 106B, at least a portion of the shuttle assembly 106 is between the conveyor system 110 and the container loading station 112 (see, e.g., FIGS. 26D-26G).

Figure 16:
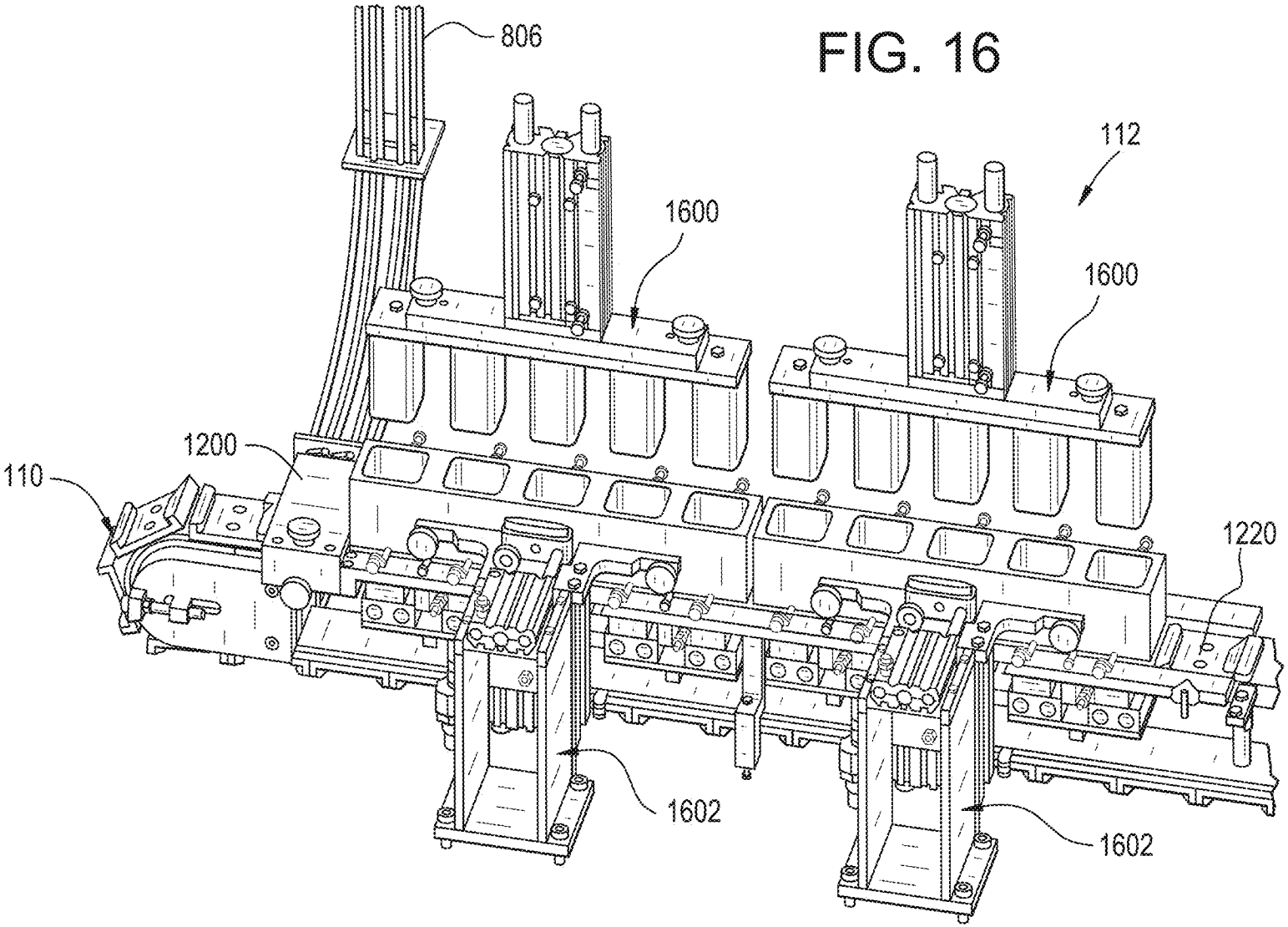
FIG. 16 is a partial perspective view of the container loading station of FIGS. 1A-1B according to at least one example embodiment.

FIG. 16 is a partial perspective view of the container loading station of FIG. 1A-1B according to at least one example embodiment.

In at least one example embodiment, as shown in FIG. 16, the container loading station 112 includes one or more tamper assemblies 1600 and one or more guide block and gate actuator assemblies 1602. In the example embodiment shown, the container loading station 112 includes two tamper assemblies 1600 and two guide block and gate actuator assemblies 1602. The tamper assemblies 1600 may be configured to tamp products into containers. The guide block and gate actuator assemblies 1602 may be configured to release products from the shuttle assembly 106 (shown in FIGS. 1A-1B), guide products into the containers, and move the containers from a partially open position to a closed position. Operation of the container loading station 112 is described in greater detail below in the discussion accompanying FIGS. 26A-26M.

The guide block and gate actuator assemblies are configured to be at least partially between the tamper assemblies 1600 and the conveyor system 110. When the shuttle assembly 106 (shown in FIGS. 1A-1B) is in the second shuttle position 106B (shown in FIG. 1A), the shuttle assembly 106 is configured to be between the tamper assemblies 1600 at least a portion of the guide block and gate actuator assemblies 1602, as described in greater detail below in the discussion accompanying FIGS. 26D-26G.

Figure 17:
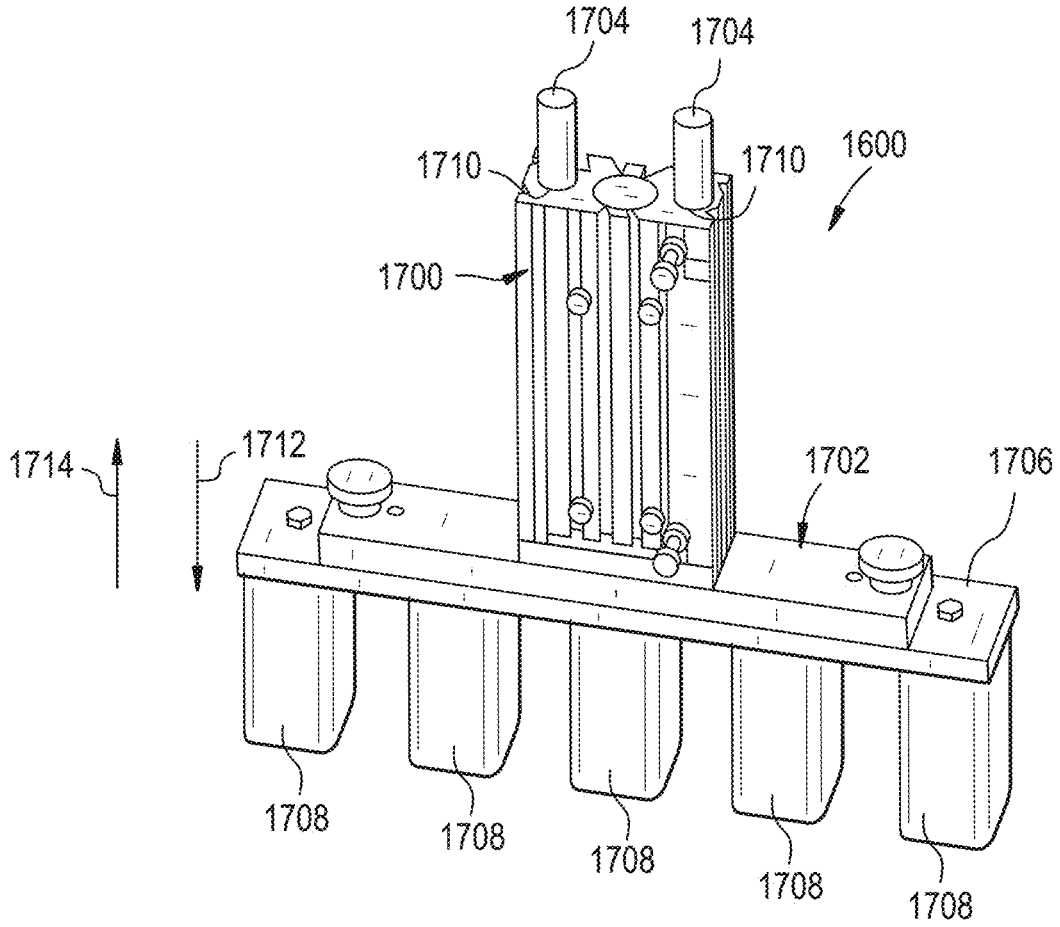
FIG. 17 is a perspective view of a tamper assembly of the container loading station of FIG. 16 according to at least one example embodiment.

FIG. 17 is a perspective view of a tamper assembly of the container filling station of FIG. 16 according to at least one example embodiment.

In at least one example embodiment, as shown in FIG. 17, the tamper assembly 1600 includes a fixed tamper portion 1700 and a movable tamper portion 1702. The fixed tamper portion 1700 is configured to be coupled to the second frame 134 (shown in FIG. 1B). A position of the fixed tamper portion 1700 may be fixed with respect to the second frame 134.

In at least one example embodiment, as shown, the movable tamper portion 1702 may include one or more tamper rods 1704, a tamper bar 1706, and a plurality of tampers or plungers 1708. A total quantity of tampers 1708 in container loading station 112 (shown in FIG. 16) may correspond to a total number of lanes 300 (shown in FIG. 3) of the product metering station 104. While the tampers 1708 are shown as having substantially square cross sections, the example embodiments are not limited thereto.

The tamper bar 1706 is coupled to the tamper rods 1704. The tampers 1708 are coupled to the tamper bar 1706. Positions of the tamper rods 1704, tamper bar 1706, and tampers 1708 may be fixed with respect to one another. The movable tamper portion 1702 may be slidably coupled to the fixed tamper portion 1700 via disposal of the tamper rods 1704 in tamper apertures 1710 of the fixed tamper portion 1700.

Figure 26H:
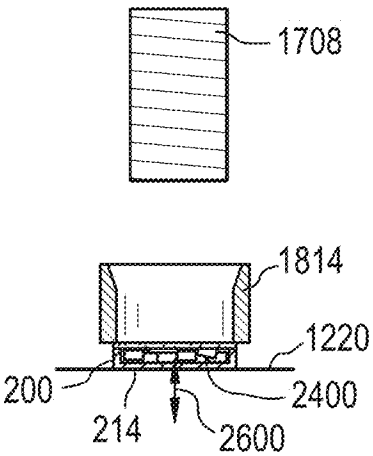
Figure 26I:
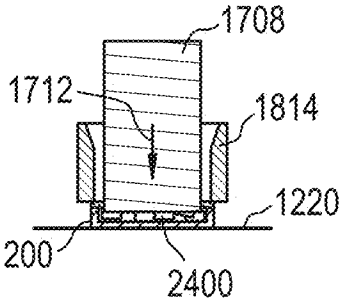

In at least one example embodiment, the movable tamper portion 1702 of the tamper assembly 1600 configured to be moved between a first tamper position (shown in FIGS. 16, 26A-H, 26K-26M) and a second tamper position (shown in FIG. 26I). The movable tamper portion 1702 may be translatable between the first and second tamper positions, such as by a linear actuator (not shown) controlled by the control system 118 (shown in FIG. 1A). In the first tamper position, the movable tamper portion 1702 is configured to be spaced apart from containers on the conveyor belt 1220 (shown in FIG. 16). In the second tamper position, the movable tamper portion 1702 is configured to be at least partially disposed within containers on the conveyor belt 1220. The movable tamper portion 1702 may translate in a first tamper direction 1712 (e.g., vertically downward) between the first tamper position and the second tamper position. The movable portion may translate in a second tamper direction 1714 (e.g., vertically upward) opposite the first tamper direction 1712 between the second tamper position and the first tamper position.

Figure 18:
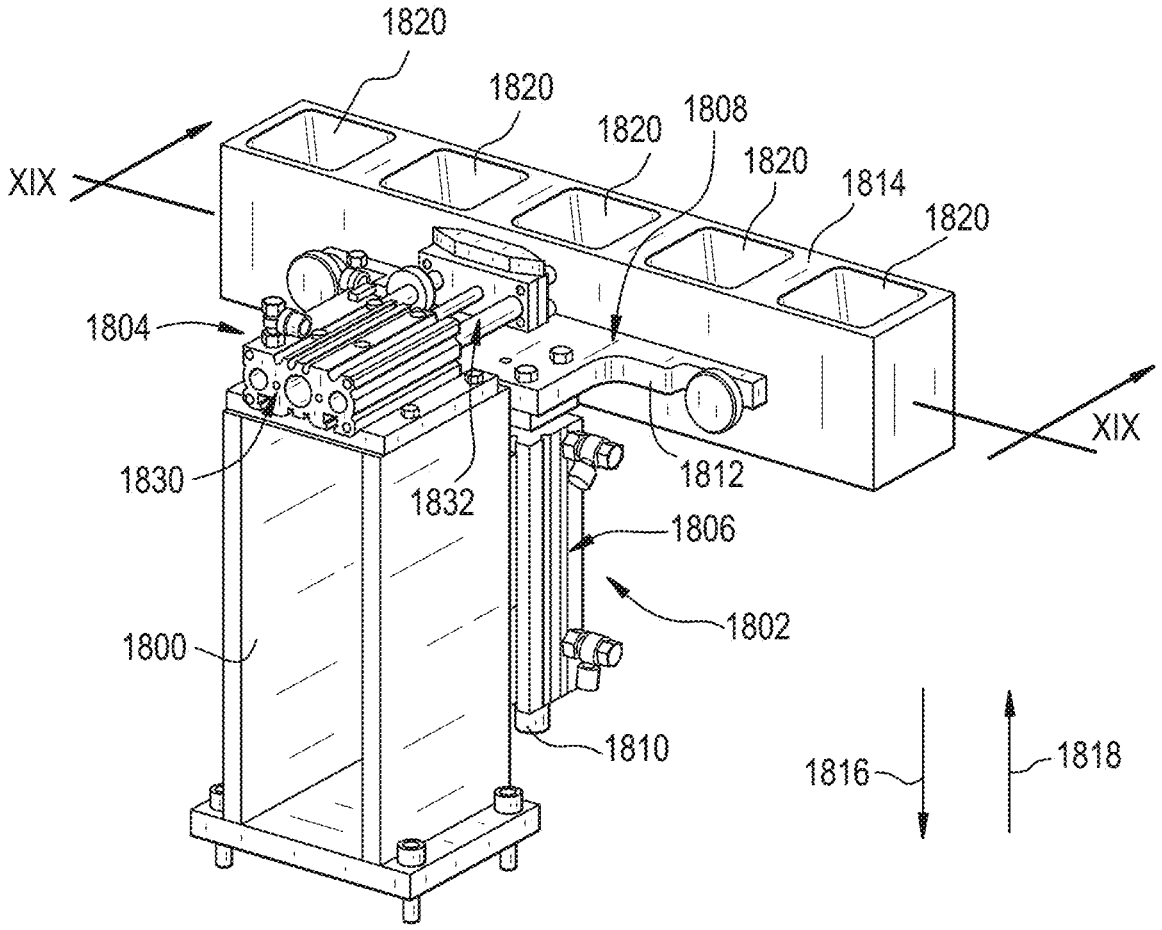
FIG. 18 is a perspective view of a guide block and gate actuator assembly of the container loading station of FIG. 16 according to at least one example embodiment.

FIG. 18 is a perspective view of a guide block and gate actuator assembly of the container filling station of FIG. 17 according to at least one example embodiment.

In at least one example embodiment, as shown in FIG. 18, the guide block and gate actuator assembly 1602 includes a base 1800, a guide block assembly 1802, and a gate actuator assembly 1804. The base 1800 is configured to be coupled to the second frame 134 (shown in FIG. 1B).

In at least one example embodiment, the guide block assembly 1802 includes a first fixed portion 1806 and a first movable portion 1808. The first fixed portion 1806 may be coupled to the base 1800. A position of the first fixed portion 1806 may be fixed with respect to the base 1800.

In at least one example embodiment, the first movable portion 1808 includes one or more guide rods 1810, a guide bar 1812, and a guide block 1814. The guide bar 1812 may be coupled to the guide rods 1810. The guide block 1814 may be coupled to the guide bar 1812. Positions of the guide rods 1810, the guide bar 1812, and the guide block 1814 may be fixed with respect to one another. The first movable portion 1808 may be slidingly coupled to the first fixed portion 1806.

The first movable portion 1808 may be configured to be moved with respect to the first fixed portion 1806, the base 1800, and the gate actuator assembly 1804. The first movable portion 1808 may be translatable between a first guide block position and a second guide block position, such as by a linear actuator (not shown). In the first guide block position, the guide block 1814 is configured to be spaced apart and disengaged from containers on the conveyor belt 1220 (shown in FIG. 16). In the second guide block position, the guide block 1814 is configured to engage at least a portion of the containers, such as the lid in the partially open and/or closed positions. The first movable portion 1808 is configured to be translated in a first guide block direction 1816 (e.g., vertically downward) between the first guide block position and the second guide block position. The first movable portion 1808 is configured to be translated in a second guide block direction 1818 (e.g., vertically upward) opposite the first guide block direction 1816 from the second guide block position to the first guide block position.

The guide block 1814 defines a plurality of guide block apertures 1820. The guide block apertures 1820 are configured to transfer or direct products. In at least one example embodiment, the guide block apertures 1820 are configured to direct products from the shuttle assembly 106 (shown in FIGS. 1A-1B) in the second shuttle position 106B (shown in FIG. 1A) to the containers on the conveyor belt 1220 (shown in FIG. 16), as described in greater detail in the discussion accompanying FIG. 26F.

Figure 19:
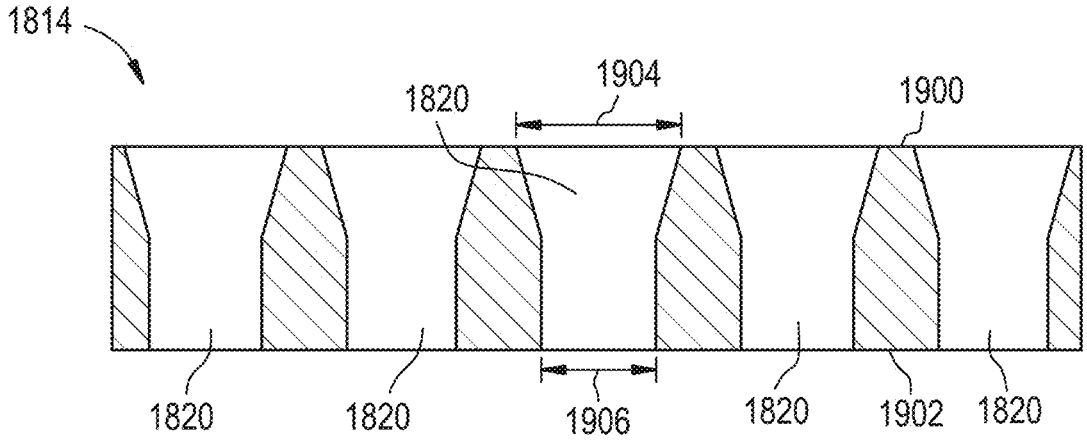
FIG. 19 is a cross-section view along line XIX-XIX of FIG. 18 according to at least one example embodiment.

FIG. 19 is a cross-section view along line XIX-XIX of FIG. 18 according to at least one example embodiment.

In at least one example embodiment, as shown in FIG. 19, the guide block apertures 1820 are configured to act as funnels for transferring the products into the containers. Each of the guide block apertures 1820 may extend between a first side 1900 of the guide block 1814 and a second side 1902 of the guide block 1814. The first side 1900 may be configured to be disposed adjacent to the shuttle assembly 106 (shown in FIGS. 1A-1B) in the second shuttle position 106B (shown in FIG. 1A). The second side 1902 may be configured to be adjacent to containers on the conveyor belt 1220 (shown in FIG. 16).

In at least one example embodiment, each of the guide block apertures 1820 defines a first transverse dimension 1904 on the first side 1900 and a second transverse dimension 1906 on the second side 1902. The first transverse dimension 1904 may be greater than the second transverse dimension 1906.

Returning to FIG. 18, in at least one example embodiment, each of the guide block apertures 1820 has a generally square cross section. Each of the guide block apertures 1820 may be configured to receive at least a portion of a respective tamper 1708 (shown in FIG. 17). Accordingly, the second dimension 1906 (shown in FIG. 19) of the guide block apertures 1820 may be large enough to accommodate the tamper 1708.

In at least one example embodiment, the gate actuator assembly 1804 includes a second fixed portion 1830 and a second movable portion or arm 1832. The second fixed portion 1830 may be coupled to the base 1800. The second fixed portion 1830 may be fixed with respect to the base 1800. The second movable portion 1832 may be configured to be moved independent of a position of the first movable portion 1808 of the guide block assembly 1802.

Figure 20:
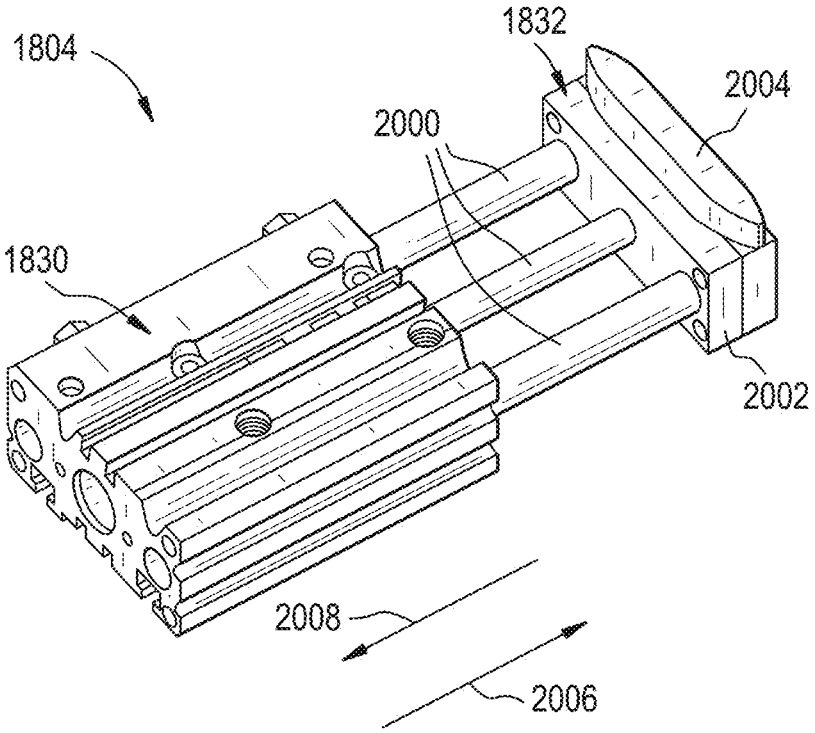
FIG. 20 is a perspective view of a gate actuator assembly of the guide block and gate actuator assembly of FIG. 18 according to at least one example embodiment.

FIG. 20 is a perspective view of a gate actuator assembly of the guide block and gate actuator assembly of FIG. 18 according to at least one example embodiment.

In at least one example embodiment, as shown in FIG. 20, the movable portion 1832 of the gate actuator assembly 1804 includes one or more gate puller rods 2000, a gate puller bar 2002, and a gate puller or protrusion 2004. The gate puller bar 2002 is coupled to the gate puller rods 2000. The gate puller 2004 is coupled to the gate puller bar 2002. Positions of the gate puller rods 2000, gate puller bar 2002, and gate puller 2004 may be fixed with respect to one another.

In at least one example embodiment, the second movable portion 1832 is configured to be moved with respect to the second fixed portion 1830. The second movable portion 1832 is translatable between a first gate puller position and a second gate puller position, such as by a linear actuator (not shown). The second movable portion 1832 is configured to translate in a first gate puller direction 2006 (e.g., away from the second fixed portion 1830 and backward with respect to the apparatus 100 of FIGS. 1A-1B) between the first gate puller position and the second gate puller position. The second movable portion 1832 is configured to translate in a second gate puller direction 2008 (e.g., toward the fixed portion 1830 and forward with respect to the apparatus 100 of FIGS. 1A-1B) opposite the first gate puller direction 2006 between the second gate puller position and the first gate puller position.

In the first gate puller position, the gate puller 2004 is configured to be disengaged from the handle 704 (shown in FIG. 7) of the shuttle assembly 106 (shown in FIG. 6). In the second gate puller position, the gate puller 2004 is configured to engage the handle 704 of the shuttle assembly 106. The gate puller 2004 may be configured to be disposed at least partially within the receptacle 706 (shown in FIG. 7) of the handle 704. When the gate puller 2004 moves from the second gate puller position to the first gate puller position while engaging the shuttle assembly 106, the gate actuator assembly 1804 causes the shuttle gate assembly 604 (shown in FIG. 6) to release the products from the shuttle assembly 106, as described in greater detail below in the discussion accompanying FIG. 26E.

Returning to FIG. 1B, in at least one example embodiment, the conveyor system 110 is configured to move containers (e.g., loaded and closed containers) to the inspection station 114.

Figure 21A:
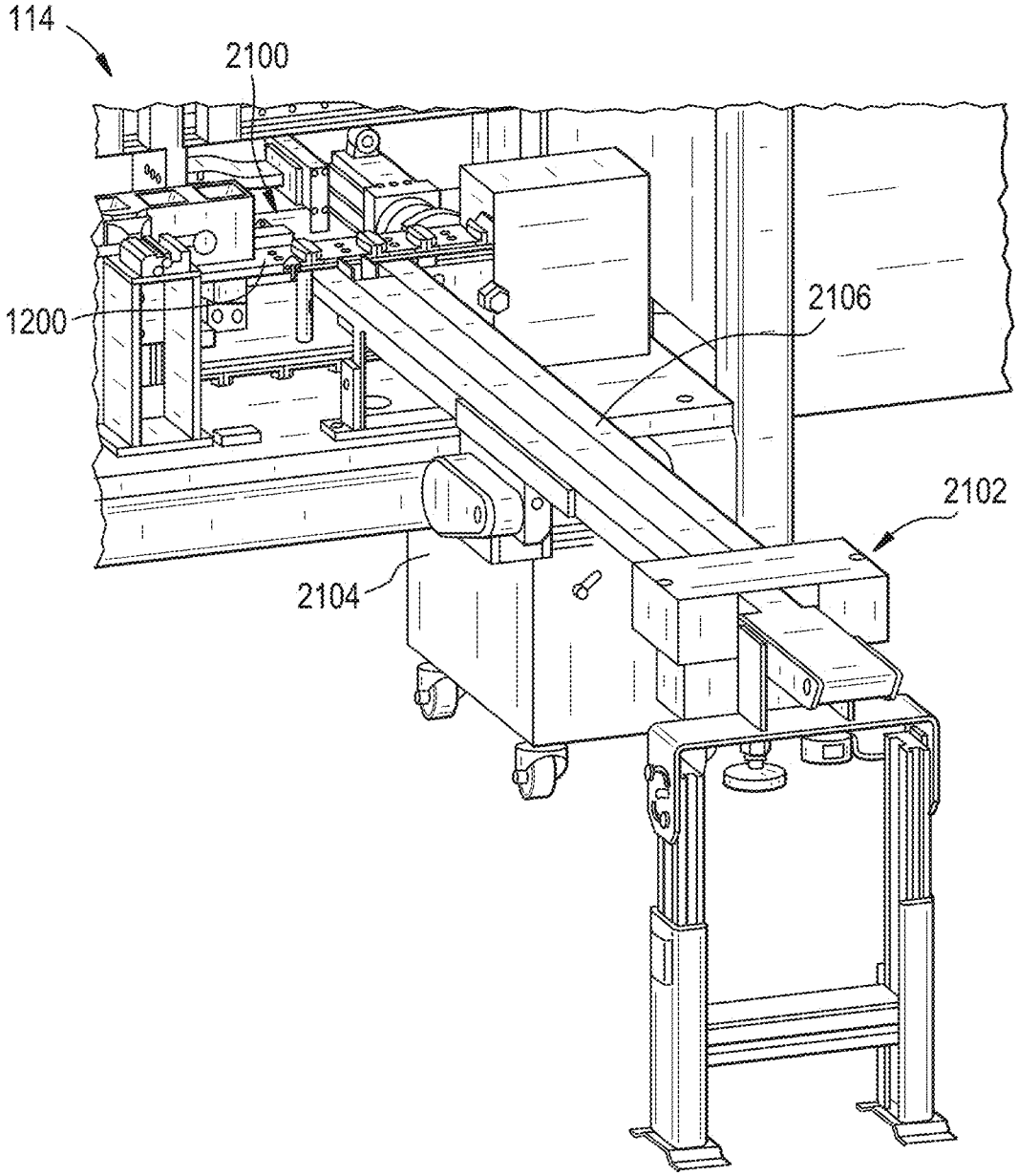
FIG. 21A-21B are a partial perspective views of an inspection station of the apparatus of FIGS. 1A-1B according to at least one example embodiment.
Figure 21B:
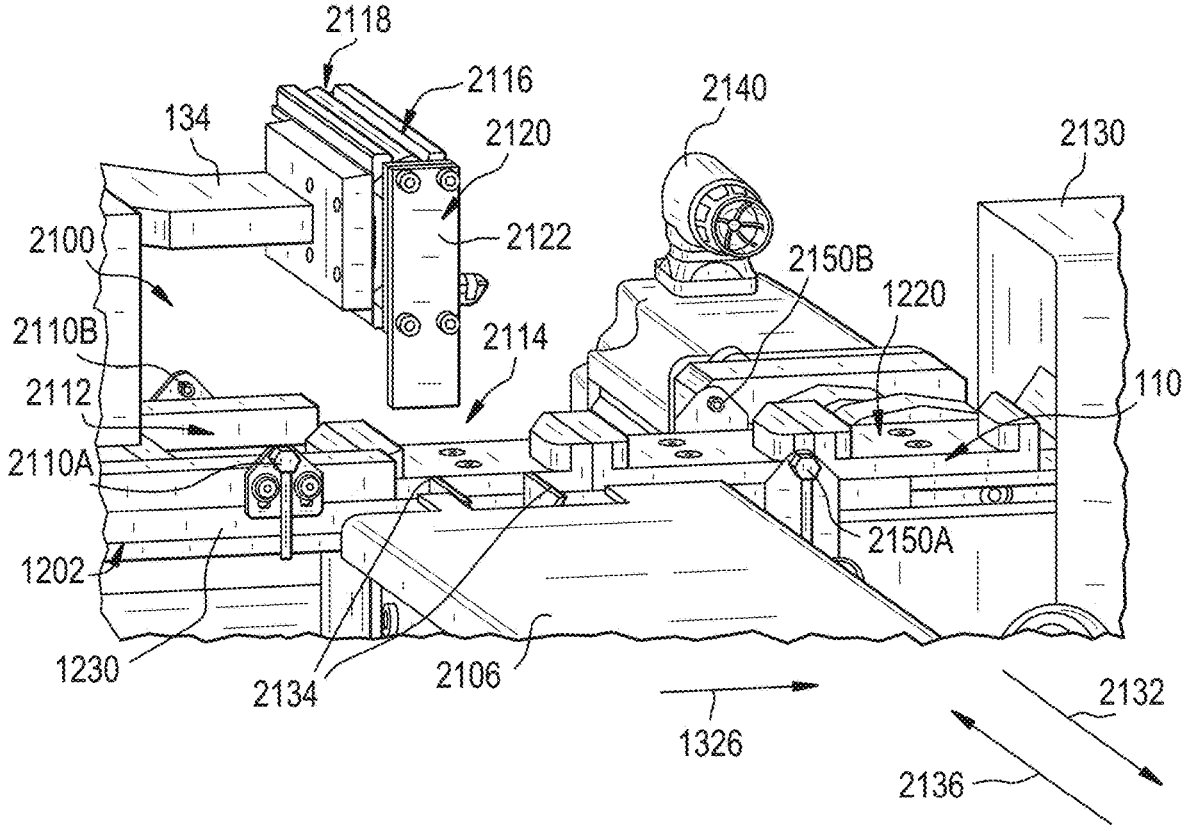

FIGS. 21A-21B are a partial perspective views of an inspection station of the apparatus of FIG. 1A-1B according to at least one example embodiment.

In at least one example embodiment, as shown in FIG. 21A, the inspection station 114 generally includes a first inspection portion 2100, a second inspection portion 2102, a reject bin 2104, and an exit conveyor 2106. The first inspection portion 2100 may be configured to receive containers from the container loading station 112. The first inspection portion 2100 may be configured to transfer containers that pass a first inspection at the first inspection portion 2100 to the second inspection portion 2102. The first inspection portion 2100 may be configured to transfer containers that fail the first inspection to the reject bin 2104.

In at least one example embodiment, as shown in FIG. 21B, the first inspection portion 2100 includes a fifth sensor 2110 (shown as 2110A, 2110B, collectively) having a transmitter 2110A and a receiver 2110B. The transmitter 2110A and receiver 2110B may be coupled to rails of the conveyor assembly 1202 in a fifth sensor region 2112. The fifth sensor 2110 may be configured to generate a signal indicating whether a container is in the fully closed position.

In at least one example embodiment, the fifth sensor 2110 is a light sensor, such as a fiber-optic sensor, a laser sensor, a photoelectric sensor, a color sensor, another type of light sensor, a non-light sensor, or any combination thereof. The transmitter 2110A is configured to emit light, such as in a form of a beam. Light being received by the receiver 2110B may indicated that the container is in the closed configuration. All or a portion of the light not being received at the receiver 2110B may indicate that the light is being blocked by a container lid, and therefore the container is not in the closed position.

In at least one example embodiment, at least a portion of a lid of a container that is in the fully open or the partially open position may be in a space between the transmitter 2110A and the receiver 2110B of the fifth sensor 2110. Sensing by the fifth sensor 2110 may be referred to as a first inspection.

The conveyor system 110 may be configured to transfer containers from the fifth sensor region 2112 to a junction region 2114. In at least one example embodiment, at the junction region 2114, the first inspection station 2100 is configured to transfer the container to the exit conveyor 2106 or the reject bin 2104 (shown in FIG. 21A). The first inspection station 2100 may transfer the container to the exit conveyor 2106 if the container passed the first inspection (i.e., the signal from the fifth sensor 2110 indicates that the container is in a fully closed position). The first inspection station 2100 may transfer the container to the reject bin 2104 if the signal from the fifth sensor 2110 indicates that the container is in a partially open or fully open position.

In at least one example embodiment, the first inspection station 2100 includes transfer assembly 2116. The transfer assembly may include a fixed transfer portion 2118 and a moving transfer portion 2120. The fixed transfer portion 2118 may be coupled to the second frame 134. A position of the fixed transfer portion 2118 may fixed with respect to the second frame 134. In at least one example embodiment, the moving transfer portion 2120 includes a foot 2122 and one or more rods (not shown). The moving transfer portion 2120 may be configured to be moved with respect to the fixed transfer portion 2118, such as by a linear actuator (not shown).

The moving transfer portion 2120 may translatable between a reject position and a pass position. In the reject position, the moving transfer portion 2120 is retracted and disengaged from the container. Accordingly, the container may continue to be transferred via the conveyor belt 1220 to a reject chute (not shown) within a reject cover 2130. The reject chute is configured to transfer the container (e.g., under the influence of gravity) into the reject bin 2104 (shown in FIG. 21A).

In the pass position, the foot 2122 of the moving transfer portion 2120 is configured to engage a container to transfer the container from the conveyor belt 1220 to the exit conveyor 2106. The moving transfer portion 2120 may move in a first transfer direction 2132 (e.g., horizontal and forward) from the reject position to the pass position. The foot 2122 may push the container over bridges 2134 between the conveyor belt 1220 and the exit conveyor 2106. The moving transfer portion 2120 may move in a second transfer direction 2136 (e.g., horizontal and backward) opposite the first transfer direction 2132 from the pass position to the reject position.

In at least one example embodiment, the conveyor system 110 includes a servo motor 2140. The servo motor 2140 is configured to drive the conveyor belt 1220. The servo motor 2140 may be disposed between the transfer assembly 2116 and the reject cover 2130.

In at least example embodiment, the conveyor system 110 further includes a sixth or homing sensor 2150 (shown as 2150A, 2150B, collectively) including a transmitter 2150A and a receiver 2150B. The homing sensor 2150 may be configured to detect an edge of one of the first and/or second conveyor cleats 1222, 1224 for positioning and/or indexing the conveyor belt 1220. In at least one example embodiment, the homing sensor 2150 may be used in a calibration procedure, such as when the apparatus 100 (FIGS. 1A-1B) is powered on.

Returning to FIG. 21A, in at least one example embodiment, the exit conveyor 2106 is configured to transfer containers from the first inspection portion 2100 to the second inspection portion 2102. The second inspection portion 2102 may include one or more sensors or measurement devices, such as a scale. The second inspection portion 2102 may be configured to perform a second inspection of the containers. In at least one example embodiment, the second inspection portion 2102 includes a seventh sensor (see, e.g., first sensor 2204 of FIG. 22A). A signal from the seventh sensor is configured to indicate whether any product is outside of the container (e.g., pinched between the container and the lid).

Figure 22A:
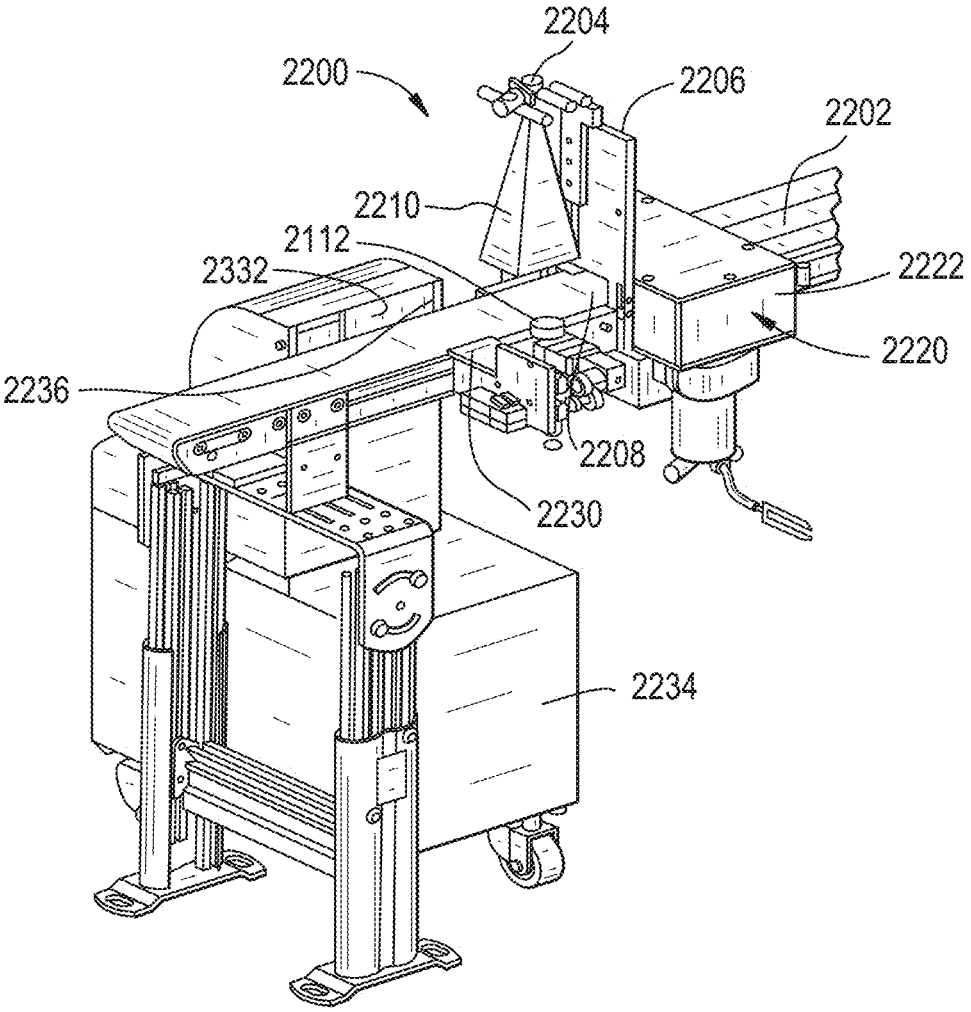
FIGS. 22A-22B depict another inspection station according to various aspects of the present disclosure.

In at least one example embodiment, the second inspection portion 2102 is configured to transfer containers that fail the second inspection to the reject bin 2104 or another reject bin (see, e.g., reject bin 2234 of FIG. 22A). In at least one example embodiment, the second inspection portion 2102 includes one or more third air nozzles (see, e.g., air nozzle 2230 of FIG. 22A) configured to direct containers that fail the second inspection to the reject bin 2104 or the other reject bin.

Figure 22B:
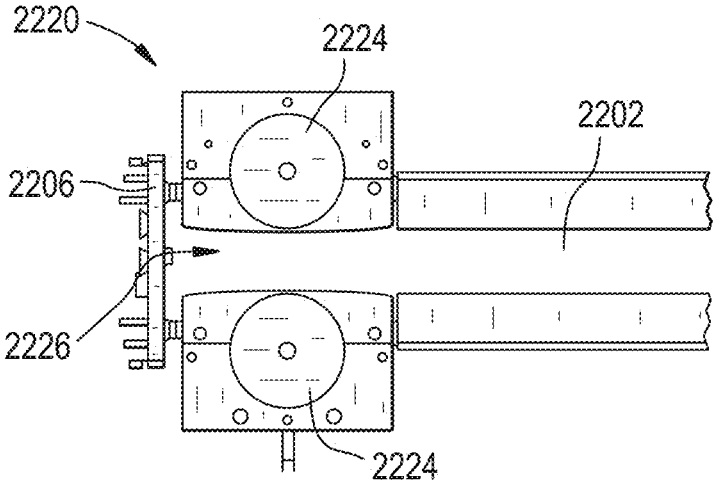

FIGS. 22A-22B depict another inspection station according to various aspects of the present disclosure. FIG. 22A is a partial perspective view. FIG. 22B is a partial top view with a housing removed.

In at least one example embodiment, as shown in FIG. 22A, an inspection station 2200 (e.g., a second inspection portion) includes an exit conveyor 2202 and a first sensor 2204. The first sensor may be coupled to a sensor support 2206. The sensor support 2206 may define a passage 2208 through which a container is configured to be conveyed. The sensor support 2206 may facilitate positioning of the first sensor 2204 about the container.

The first sensor 2204 may be configured to detect when at least a portion of the product is outside of the container (e.g., stuck between a container base and lid). More particularly, a signal from the first sensor 2204 may indicate whether any portion of the container including the product exceeds a predetermined perimeter. If so, product may not be fully enclosed in the container. In at least some example embodiments, the first sensor 2204 is a smart sensor configured to capture an image of the container. The first sensor 2204 may include a camera. The first sensor 2204 may be configured to have a field of view 2210.

In at least one example embodiment, the inspection system 2200 may further include a second sensor 2212. The second sensor 2212 may include a transmitter 2212A and a receiver (not shown). A signal from the second sensor 2212 may indicate whether a container is present and in range (e.g., within the field of view 2210) of the first sensor 2204.

The second sensor 2212 may be a light sensor, such as a fiber-optic sensor, a laser sensor, a photoelectric sensor, a color sensor, another type of light sensor, a non-light sensor, or any combination thereof. The transmitters 2212A is configured to emit light. In at least one example embodiment, the light may be emitted as a beam. All or a portion of the light not being received at the receiver may indicate that the light is being blocked by a container, and therefore, that the container may be in place in range of the first sensor 2204.

In at least one example embodiment, the inspection system may further include a container spacing assembly 2220. The container spacing assembly 2220 may include a housing 2222 through which containers on the exit conveyor 2202 are configured to pass.

In at least one example embodiment, as shown in FIG. 22B, the container spacing assembly 2220 may include a pair of regulating wheels 2224. The regulating wheels 2224 may be spaced apart from one another to define a passage 2226. The regulating wheels 2224 may be configured to ensure a desired (or alternatively, predetermined) spacing between containers upstream of the first sensor 2204 (FIG. 22A). In at least one example embodiment, the regulating wheels 2224 are configured to move a slower linear speed than the exit conveyor 2202 to ensure that the containers are not abutting one another as they pass through the field of view 2210 (shown in FIG. 22A) of the first sensor 2204 (shown in FIG. 22A).

Returning to FIG. 22A, in at least one example embodiment, the inspection station 2200 is configured to eject containers that do not pass inspection (e.g., product is not fully enclosed by the container, as determined by a signal from the first sensor 2204. The inspection system 2200 may include an air nozzle 2230 downstream of the first sensor 2204. The air nozzle 2230 may be configured to direct one or more streams of air toward a container to direct the container into a reject chute 2232. The reject chute 2232 may be configured to guide rejected containers into a reject bin 2234.

In at least one example embodiment, the inspection station 2200 may include a third sensor 2236 adjacent to the reject chute 2232. The third sensor 2236 may be configured to indicate whether a container has been transferred from the exit conveyor 2202 to the reject chute 2232. The third sensor 2236 may be a light sensor, such as a fiber-optic sensor, a laser sensor, a photoelectric sensor, a color sensor, another type of light sensor, a non-light sensor, or any combination thereof.

Figure 23:
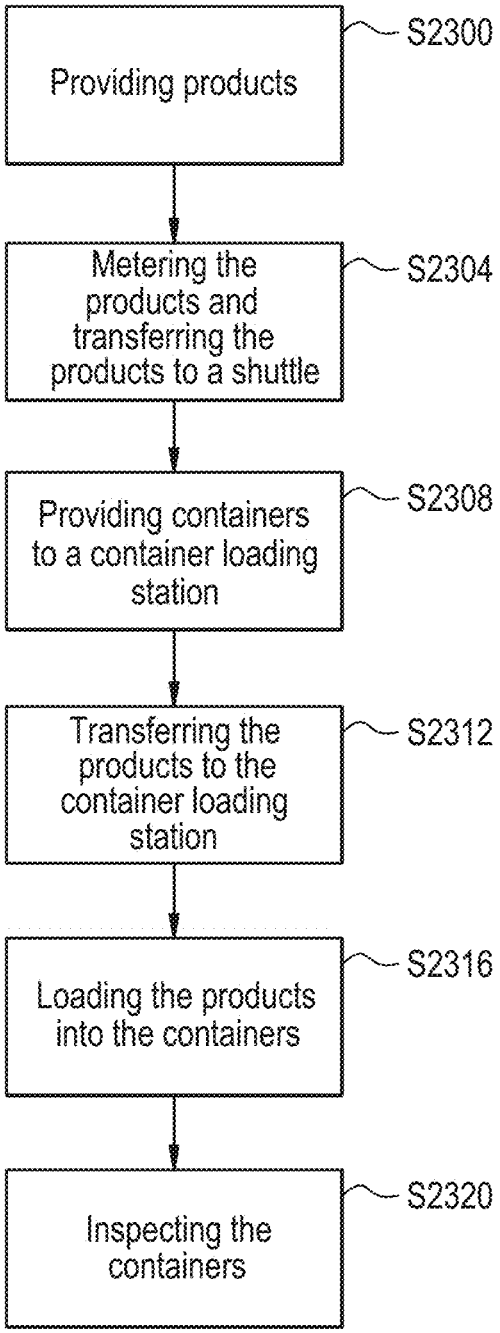
FIG. 23 is a flowchart depicting a method of loading containers with products according to at least one example embodiment.

FIG. 23 is a flowchart depicting a method of filling containers with products according to at least one example embodiment.

In at least one example embodiment, as shown in FIG. 23, a method of loading a container with a product includes providing a product at S2300. At S2304, the method may include metering the product and transferring the product to a shuttle. At S2308, the method may further include providing containers to a container loading station. At S2312, the method may further include transferring the products to the container loading station. At S3216, the method may further include loading the products into the containers. At S3220, the method may further include inspecting the containers.

Providing products at S2300 may, in at least one example embodiment, include forming the products. The products may be formed at the product forming station 102 of FIGS. 1A-1B. In at least one example embodiment, forming the products includes forming oral pouch products.

Metering the product and transferring the shuttle at S2304 may be performed at the product metering station 104 of FIGS. 1A-1B.

FIGS. 24A-24E are partial cross-section views depicting the metering the product and transferring the product to a shuttle according to the method of FIG. 23 according to at least one example embodiment.

In at least one example embodiment, as shown in FIGS. 24A-24E, S2304 may be performed at one or more of the lanes 300 of the product metering station 104 (shown in FIGS. 1A-1B). S2304 may be performed while the shuttle assembly 106 is in the first shuttle position 106A (shown in FIG. 1A), the second shuttle position 106B (shown in FIG. 1A), between the first and second shuttle positions 106A, 106B, or any combination thereof, as shown. Accordingly, in at least one example embodiment, products 2400 are continuously provided to each of the lanes 300 regardless of a position of the shuttle assembly 106.

Figures 24A, 24B, 24C, 24D, 24E:
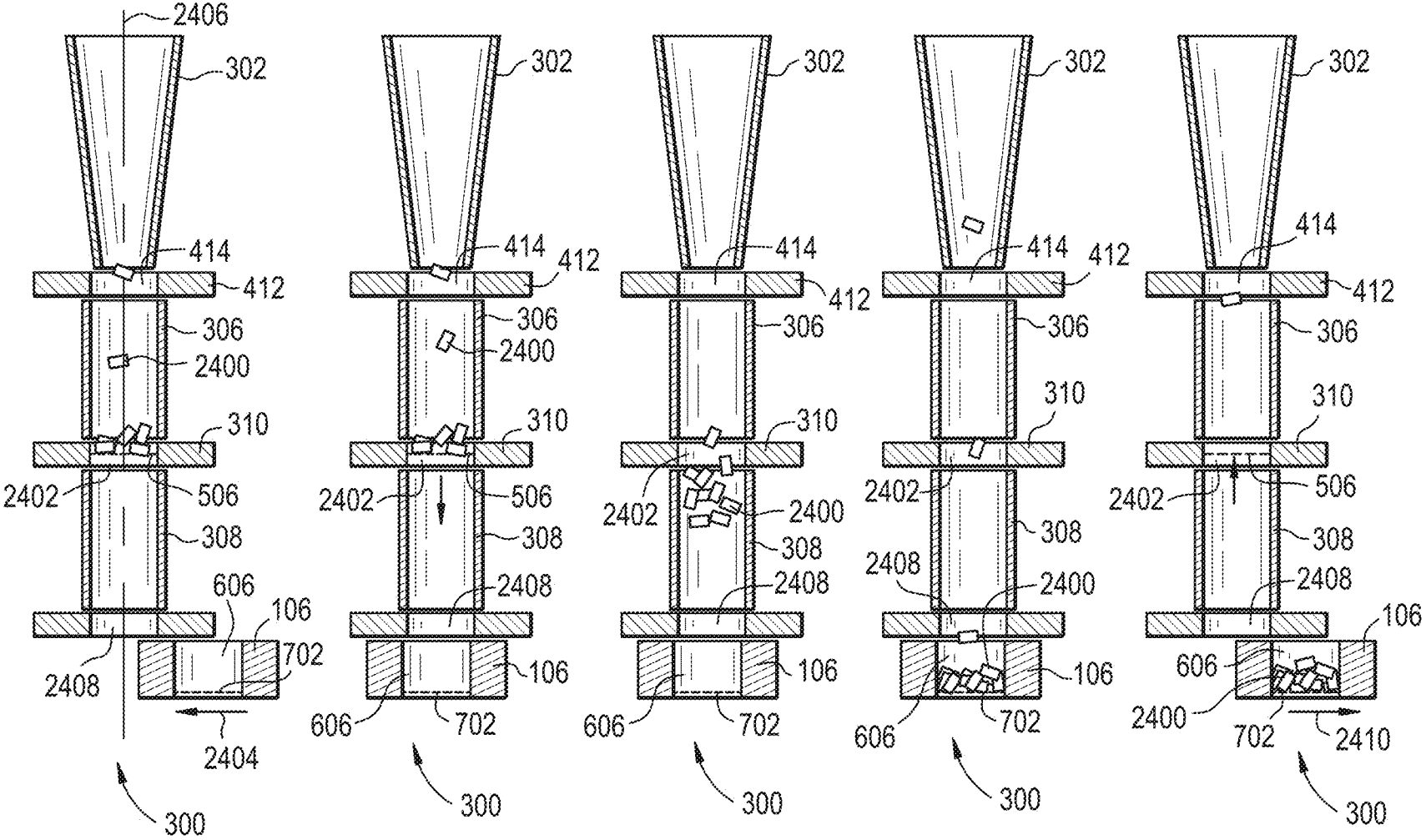
FIGS. 24A-24E are partial cross-section views depicting a method of loading products into the shuttle assembly according to at least one example embodiment.

In at least one example embodiment, as shown in FIG. 24A, the shuttle assembly 106 may be away from the first shuttle position 106A, such as in the second shuttle position or an intermediate shuttle position between the first and second shuttle positions. While the shuttle assembly 106 is away from the first shuttle position, S2304 may include transferring a plurality of products 2400 from one of the diverter chutes 302 to one of the respective upper filling tubes 306. The products 2400 may be received by the diverter chute 302, transferred through the upper aperture 414 of the upper filling plate 412, and into the upper filling tube 306, such as by gravity. The filling gate 506 may be in the first filling gate position such that the filling gate 506 retains the products within a middle aperture 2402 of the middle filling plate 310 and/or in the upper filling tube 306.

In at least one example embodiment, the control system 118 may be configured to determine whether products have been transferred into the upper filling tubes 306. The control system 118 may be configured to process the data signal from first sensor 410 (shown in FIG. 4) to determine whether products have been transferred from diverter chute 302 to upper filling tube 306. If product has not been transferred, the control system 118 may be configured to adjust operation of the apparatus 100 (shown in FIGS. 1A-1B) to ensure that a desired or predetermined number of products 2400 reach the portion of the machine (e.g., by performing additional rotations of metering device 320 of FIG. 3).

The shuttle assembly 106 may be translated in a first shuttle direction 2404 (e.g., a horizontal direction) from the second shuttle position to the first shuttle position while products 2400 are being retained by the filling gate 506.

In at least one example embodiment, as shown in FIG. 24B, the shuttle assembly 106 may be in the first shuttle position. In the first shuttle position, the product aperture 606 of the shuttle assembly 106 may be substantially aligned with the diverter chute 302, the upper filling tube 306, and the lower filling tube 308, such as along a longitudinal axis 2406 of the lane 300. When the shuttle assembly 106 is in the first shuttle position, S2304 may include moving the filling gate 506 from the first filling gate position to the second filling gate position to permit the products 2400 to transfer through the middle aperture 2402.

As shown in FIG. 24C, S2404 may include transferring the products 2400 through the lower filling tube 308 and a lower aperture 2408 of the lower filling plate 312 and into the product aperture 606 of the shuttle assembly 106, such as by gravity. The products 2400 may be retained at least partially within the product aperture 606 by the shuttle gate 702 in the first shuttle gate position.

As shown in FIG. 24D, the diverter chute 302 may continue to receive products 2400. The products 2400 may be transferred from the diverter chute 302 to the upper filling tube 306 and directly through the middle aperture 2402, the lower filling tube 308, and the lower aperture 2408 without being stopped by the filling gate 506. The shuttle assembly 106 may continue to receive products 2400 in the above manner until a desired (or alternatively, predetermined) number of products 2400 have been received in each of the product apertures 606 of the shuttle assembly 106.

In at least one example embodiment, as shown in FIG. 24E, S2304 may include translating the shuttle assembly 106 in a second shuttle direction 2410 (e.g., a horizontal direction) opposite the first shuttle direction 2404 from the first shuttle position to the second shuttle position. In at least one example embodiment, the first and second shuttle directions 2404, 2410 are substantially horizontal. S2304 may further include moving the filling gate 506 from the second filling gate position to the first filling gate position.

Returning to FIG. 23, in at least one example embodiment, providing containers to a container loading station may be performed by the container station 108 (shown in FIGS. 1A-1B). In at least one example embodiment, S2308 may include delivering one of the containers 200 (shown in FIGS. 2A-2E) to the nest 902 (shown in FIG. 9) via the receiving opening 917.

FIGS. 25A-25H are schematic views depicting a method of partially opening the container of FIGS. 2A-2E using the pre-opening assembly of FIG. 9 according to at least one example embodiment. FIGS. 2A, 2C, and 2E are front cross-sectional views. FIGS. 2B. 2D, and 2F are side cross-sectional views.

Figure 25B:
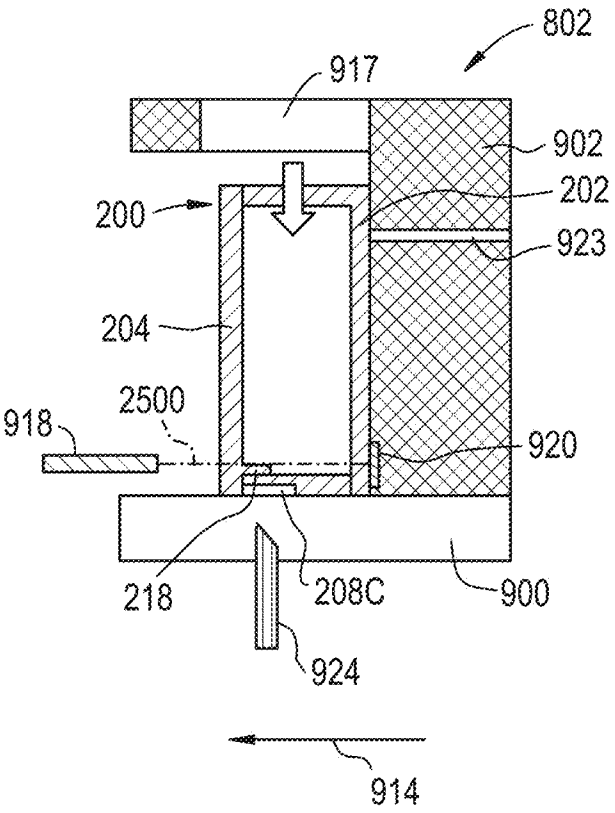
FIGS. 25A-25F are schematic views depicting a method of partially opening the container of FIGS. 2A-2E using the pre-opening assembly of FIG. 9 according to at least one example embodiment.
Figure 25A:
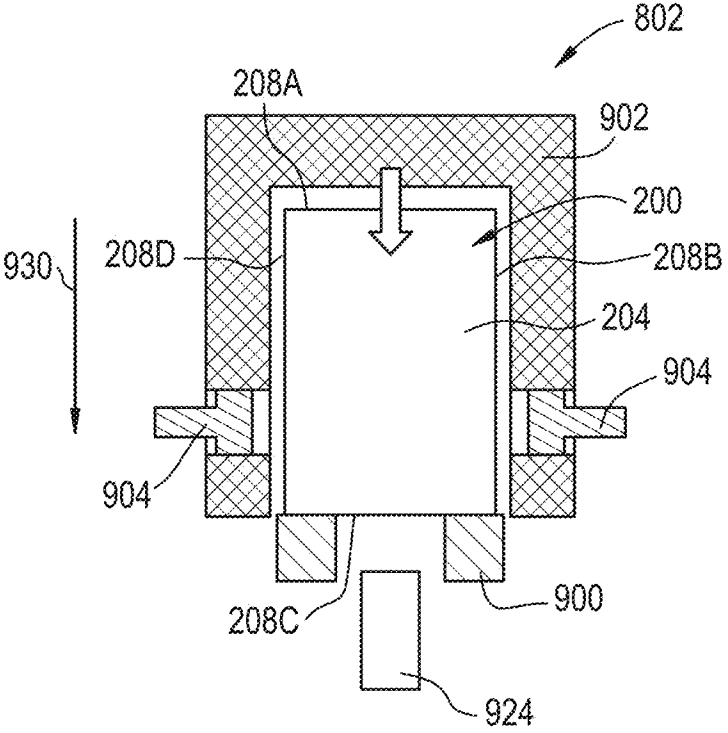

As shown in FIGS. 25A-25B, the container 200 may be oriented such that its third side wall 208C is in the fourth opener direction 930 (e.g., downward) with respect to the first side wall 208A and the lid 204 is in the first opener direction 914 (e.g., forward) with respect to the container base 202. The container 200 may be in the closed configuration.

In at least one example embodiment, S2308 includes determining whether the container 200 is present in the nest 902. In at least one example embodiment, the control system 118 (shown in FIG. 1A) may be configured to determine whether the container 200 is present in the nest 902. The control system 118 may be configured to process a data signal 2500 from the second sensor 918 (shown, with the reflector 920, transposed onto nest 902) to determine whether the container 200 is present in the nest 902.

In at least one example embodiment, the control system 118 may be configured to adjust operation of the apparatus 100 (shown in FIGS. 1A-1B) if the container 200 is not present in the nest 902, such as providing another container 200 via the receiving chute 804 (shown in FIG. 8). If the container 200 is present in the nest 902, it may be retained by a vacuum applied at the vacuum aperture 923.

Figure 25D:
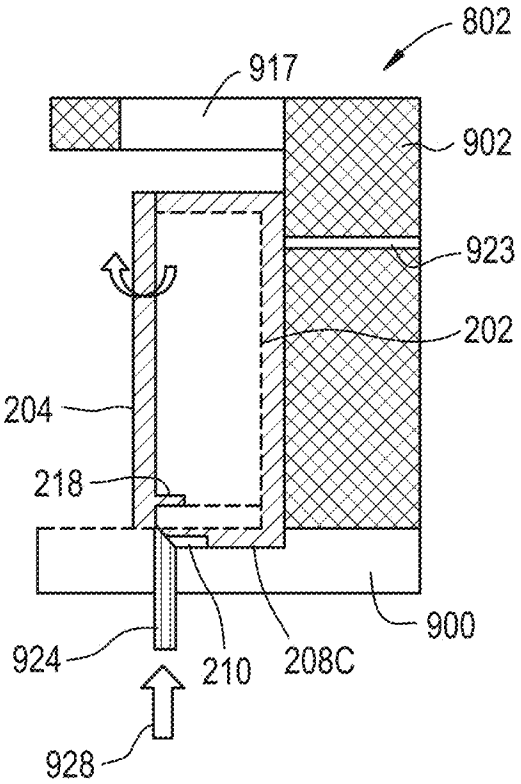
Figure 25C:
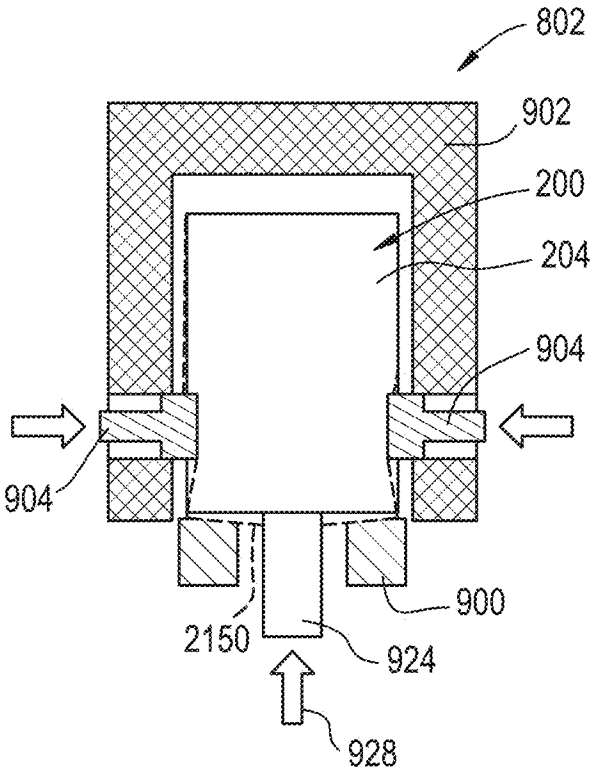

In at least one example embodiment, as shown in FIGS. 25C-25D, S2308 may include deforming the container 200. Deforming the container 200 may include moving the pinchers 904 from the retracted position (shown in FIG. 9A) to the pinch position, as shown. In a deformed position 2510, the second and fourth side walls 208B, 208D of the container 200 may be bowed into a concave shape and the third side wall 208C may be bowed into a convex shape. The lid 204 may substantially retain its shape while the container base 202 is deformed. Accordingly, the third side wall 208C may become disengaged from the latch 218 of the lid 204.

In at least one example embodiment, S2308 includes partially opening the container 200 (i.e., moving the container from the closed position to the partially opened position). The container 200 may, in at least one example embodiment, be partially opened while it is in the deformed position 2510 (i.e., while the pinchers 904 engage the container body 202). Partially opening the container 200 may include moving the blade 924 from the second blade position (shown in FIGS. 25A-25B) to the first blade position, as shown. In the first blade position, the blade 924 may be at least partially disposed in the first scallop 210 of the container base 202. The blade 924 may engage the lid 204 to facilitate transition of the container 200 from the closed position to the partially open position.

In at least one example embodiment, S2308 may include determining whether the container 200 is in the partially open position. The control system 118 may be configured to determine whether the container 200 is in the partially open position. The control system 118 may be configured to process the data signal from the third sensor 932 (shown transposed onto the nest 902) to determine whether the container 200 is in the partially open position (e.g., based on whether the lid 204 interrupts a space between the transmitter and receiver of the third sensor 932).

In at least one example embodiment, if the container 200 is not in the partially open position (i.e., the container 200 is in the closed position), the blade 924 may return to the second blade position and then repeat movement from the second blade position to the first blade position. This sub-step may be repeated a desired (or alternatively predetermined) number of times to attempt to partially open the container 200. In at least one example embodiment, the pinchers 904 remain in the pinch position while this sub-step is repeated. In at least one other example embodiment, the pinchers 904 may return to the retracted position and repeat movement to the pinch position prior to repeating movement of the blade 924.

Figure 25F:
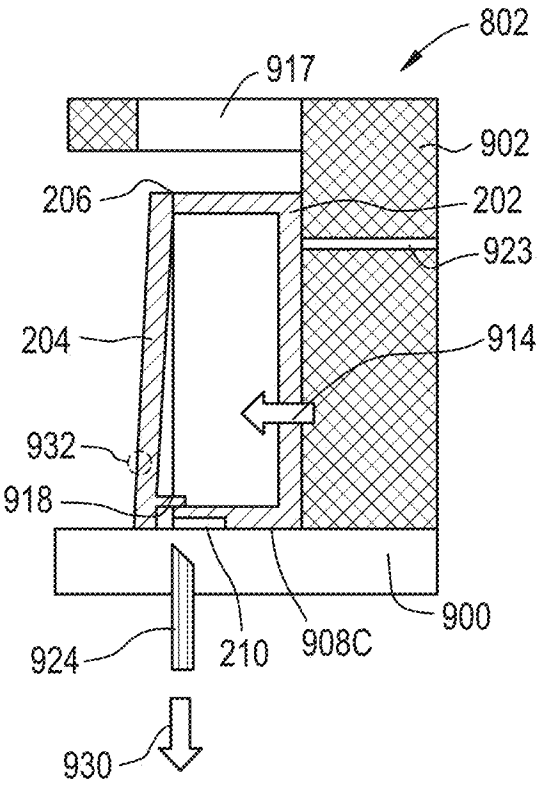
Figure 25E:
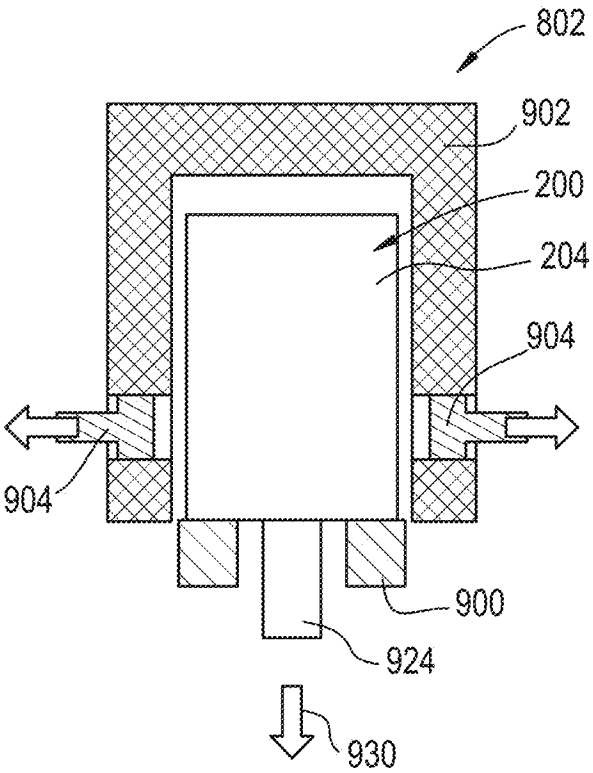

In at least one example embodiment, as shown in FIGS. 25E-25F, the blade 924 may be moved in the fourth opener direction 930 (e.g., downward) from the first blade position to the second blade to disengage the container 200.

In at least one example embodiment, S2308 may include moving the nest 902 in the first opener direction 914 (e.g., forward) from the first nest position, as shown, to the second nest position. The container 200 and pinchers 904 may be configured to move together with the nest 902. In at least one example embodiment (not shown), the container 200 may remain between the pinchers 904 in the pinch configuration during all or a portion of the movement from the first nest position to second nest position.

In at least one example embodiment, the pinchers 904 may be moved from the pinch position to the retracted position. The container 200 may transition from the deformed position 2510 (shown in FIG. 25C) to the original position as the pinchers 904 move from the pinch position to the retracted position. In at least one example embodiment, when the nest 902 is in the second nest position and the pinchers 904 are in the retracted position, the container 200 may be free to be transferred through the transfer opening 938 (shown in FIG. 9) and the transfer chute 806 (shown in FIG. 9).

In at least one example embodiment, the blade 924 moves from the first blade position to the second blade position, the nest 902 moves from the first nest position, and the pinchers 904 move from the pinch position to the retracted position sequentially, as described. However, in at least one other example embodiment, movement of the blade 924, the nest 902, and the pinchers 904 is performed in a different order, concurrently, or simultaneously.

Returning to FIGS. 12-13, in at least one example embodiment, S2308 may include transferring the container 200 (shown in FIGS. 2A-2E) to the through the garage opening 1214 and into the garage assembly 1200. In at least one example embodiment, transferring the container 200 into the garage assembly 1200 may include directing a fluid, such as air, through the chute nozzles 1300 (shown in FIG. 13) to push the container 200 toward or into the garage assembly 1200.

In at least one example embodiment, S2308 may include determining whether the container 200 is properly seated on the conveyor belt 1220 in the garage assembly 1200. The control system 118 (shown in FIG. 1A) may be configured to determine whether the container 200 is properly seated in the garage assembly 1200. The control system 118 may be configured to process data from the fourth sensor 1302 (shown in FIG. 13) to determine whether the container 200 is properly seated in the garage assembly 1200. If the container 200 is properly seated, S2308 may include advancing the conveyor belt 1220 in the conveyance direction 1326 to fill additional pockets 1226 with additional containers 200 until a desired or predetermined number of pockets have been filled. Otherwise, if the container 200 is not properly seated, the control system 118 may be configured to adjust operation of the apparatus 100 (shown in FIGS. 1A-1B), such as by operating the chute nozzles 1300 and/or providing another container 200 to the garage assembly 1200 from the transfer chute 806.

Returning to FIG. 23, the products may be transferred to the container loading station 112 (shown in FIGS. 1A-1B) at S2312. In at least one example embodiment, S2312 includes translating the shuttle assembly 106 from the first shuttle position 106A (shown in FIG. 1A) to the second shuttle position 106B (shown in FIGS. 1A-1B).

At S2316, the products may be loaded into the containers.

FIGS. 26A-26M are cross-section views depicting a method of loading products into containers according to at least one example embodiment.

In at least one example embodiment, as shown in FIG. 26A, S2312 includes advancing the conveyor belt 1220 in the conveyance direction 1326 to axially align one of the containers 200 with one of the tampers 1708 and a portion of one of the guide blocks 1814. The container 200 may be in the partially open position. The tamper 1708 may be in the first tamper position. The guide block 1814 may be in the first guide block position. The tamper 1708 may be nested at least partially inside of the guide block aperture 1820 of the guide block 1814.

In at least one example embodiment, S2312 may include fixing a position of the container 200. Fixing the position of the container 200 may include clamping the container 200 with the gripper assemblies 1408 (shown in FIG. 14). More particularly, first and third side walls 208A, 208 (shown in FIGS. 2A-2E) of the container may be engaged by the first and second clamping portions 1502, 1504 (shown in FIG. 15), respectively, of the gripper assembly 1408.

In at least one example embodiment, as shown in FIG. 26B, S2312 may include directing a fluid, such as air, from the second air nozzle 1516 (shown in FIG. 15) to move the container 200 from the partially open position to the fully open position. S2312 may include engaging the lid 204 of the container 200 with the suction cup 1514 (shown in FIG. 15) to retain the container 200 in the fully open position. The tamper 1708 may remain in the first tamper position. The guide block 1814 may remain in the first guide block position.

In at least one example embodiment, as shown in FIG. 26C, S2312 may include moving the guide block 1814 in the first guide block direction 1816 from the first guide block position to the second guide block position, as shown. The container 200 may remain in the fully open position due to engagement with the vacuum suction cup 1514 (shown in FIG. 15) and/or placement of the guide block 1814. In at least one example embodiment, the vacuum nozzle 1512 (shown in FIG. 15) is turned off and the container 200 is retained in the fully open position by the guide block 1814. The tamper 1708 may remain in the first tamper position.

In at least one example embodiment, as shown in FIG. 26D, S2312 may include moving the shuttle assembly 106 in the first shuttle direction 2404 from the first shuttle position to the second shuttle position. In the second shuttle position, the shuttle assembly 106 may be between the guide block 1814 and the tamper 1708. One of the product apertures 606 of the shuttle assembly 106 may be substantially axially aligned with the tamper 1708, the guide block aperture 1820, and the container 200. The products 2400 are retained in the product aperture 606 of the shuttle assembly 106 by the shuttle gate 702 in the first shuttle gate position. The container 200 may remain in the fully open position. The tamper 1708 may remain in the first tamper position. The guide block 1814 may remain in the second guide block position.

In at least one example embodiment, as shown in FIG. 26E, S2312 may include releasing the products 2400 from the product aperture 606 of the shuttle assembly 106. Releasing the products 2400 may include moving the shuttle gate 702 from the first shuttle gate position, as shown, to the second shuttle gate position. The shuttle assembly 106 may remain in the second shuttle position. The container 200 may remain in the fully open position. The tamper 1708 may remain in the first tamper position. The guide block 1814 may remain in the second guide block position.

In at least one example embodiment, as shown in FIG. 25F, S2312 may further include transferring the products 2400 through the guide block aperture 1820. The guide block aperture 1820 may receive the products from the product aperture 606 of the shuttle assembly 106 at the first side 1900 of the guide block 1814. The products 2400 may exit the guide block aperture 1820 at the second side 1902 of the guide block 1814 to be transferred into the container 200, such as by gravity. The shuttle assembly 106 may remain in the second shuttle position with the shuttle gate 702 (shown in FIG. 26E) in the second shuttle gate position. The container 200 may remain in the fully open position. The tamper 1708 may remain in the first tamper position. The guide block 1814 may remain in the second guide block position.

In at least one example embodiment, as shown in FIG. 26G, S2312 may include moving the shuttle gate 702 from the second shuttle gate position to the first shuttle gate position, as shown. S2312 may include moving the shuttle assembly 106 in the second shuttle direction 2410 from the second shuttle position, as shown, to the first shuttle position. The container 200 may remain in the fully open position. The tamper 1708 may remain in the first tamper position. The guide block 1814 may remain in the second guide block position.

In at least one example embodiment, as shown in FIG. 26H, S2312 may include settling the products 2400 within the container 200. Settling the products 2400 within the container 200 may reduce a volume a product protruding outside of the interior region 207 of the container 200. Settling the products 2400 may include operating the shaker cylinder 1404 (shown in FIG. 14) to shake the container 200 having the products 2400 therein, as indicated at 2600. The container 200 may remain in the fully open position. The tamper 1708 may remain in the first tamper position. The guide block 1814 may remain in the second guide block position.

In at least one example embodiment, as shown in FIG. 26I, S2312 may include tamping the products 2400 in the container 200. Tamping the products 2400 may further reduce the volume of products 2400 protruding from the interior region 207 of the container 200. Tamping the products 2400 may include moving the tamper 1708 in the first tamper direction 1712 from the first tamper position to the second tamper position. In the second tamper position, the tamper 1708 at least partially disposed in the interior region 207 of the container 200. In the second tamper position, the tamper 1708 may be configured to engage at least a portion of the products 2400. The container 200 may remain in the fully open position. The guide block 1814 may remain in the second guide block position.

Figure 26J:
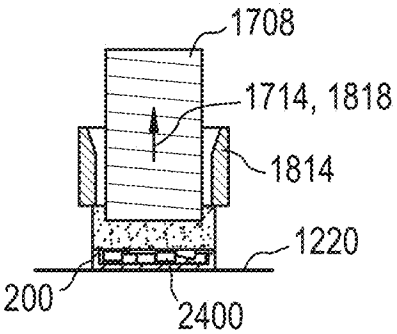

In at least one example embodiment, as shown in FIG. 26J, S2312 may include moving the tamper 1708 in the second tamper direction 1714 from the second tamper position to the first tamper position. S2312 may include moving the guide block 1814 in the second guide block direction 1818 from the second guide block position to the first guide block position. Movement of the tamper 1708 and the guide block 1814 may be simultaneous, concurrent, or sequential.

Figure 26K:
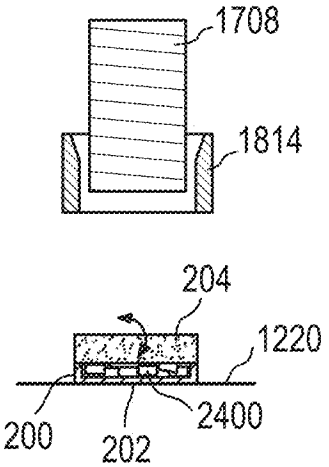

In at least one example embodiment, as shown in FIG. 26K, S2312 may include moving the container 200 from the fully open position to the partially open position. Moving the container 200 to the partially open position may include stopping operation of the vacuum nozzle 1512 (shown in FIG. 15). In at least one example embodiment, the container 200 is configured to be moved to the partially open configuration when the guide block 1814 is moved away from the second guide block position and clears the lid 204. In at least one example embodiment, moving the container 200 to the partially open position may include directing a fluid, such as air, from the third air nozzle (see discussion accompanying FIG. 12) toward the lid 204 to move the lid 204 toward the container base 202. The tamper 1708 may be in the first tamper position. The guide block 1814 may be in the first guide block position.

Figure 26L:
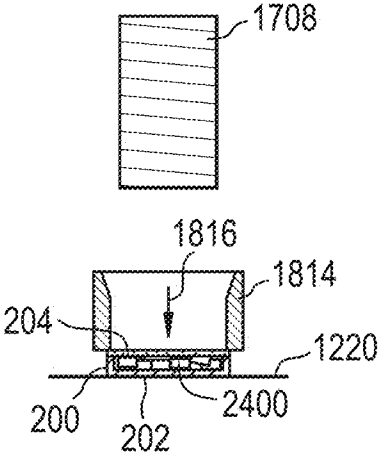

In at least one example embodiment, as shown in FIG. 26L, S2312 may include moving the container 200 from the partially open position to the closed position. Moving the container 200 to the closed position may include moving the guide block 1814 in the first guide block direction 1816 from the first guide block position to the second guide block position. In the second guide block position, the guide block 1814 engages the lid 204 of the container 200 to move the container 200 into the closed position. The tamper 1708 is in the first tamper position.

Figure 26M:
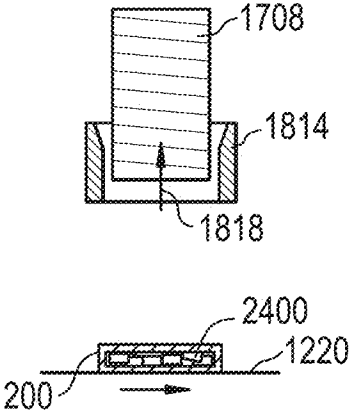

In at least one example embodiment, as shown in FIG. 26M, S2312 may include moving the guide block 1814 in the second guide block direction 1818 from the second guide block position to the first guide block position. S2312 may include moving the container 200 in the conveyance direction 1326 to the inspection station 114 (shown in FIGS. 1A-1B). Moving the container 200 may include moving the conveyor belt 1220 in the conveyance direction 1326. Moving the guide block 1814 and moving the container 200 may be performed simultaneously, concurrently, or sequentially. The container 200 may remain in the closed position. The tamper 1708 may remain in the first tamper position.

Returning to FIG. 23, in at least one example embodiment, at S2316, the method includes inspecting the containers 200.

Returning to FIGS. 21A-21B, in at least one example embodiment, S2316 may include performing a first inspection of the container 200 (shown in FIGS. 2A-2E). The first inspection may include determining whether the container 200 is in the closed position. The control system 118 may be configured to determine whether the container 200 is in the closed position. The control system 118 may be configured to process the data signal from the fifth sensor 2110 to determine whether the container 200 is in the closed position.

If the container is in the closed position, S2316 may include transferring the container 200 to the exit conveyor 2106. Transferring the container 200 to the exit conveyor 2106 may include operating the transfer assembly 2116 to engage the foot 2122 of the transfer assembly 2116 with the container 200 and push the container 200 onto the exit conveyor 2106.

Otherwise, if the container 200 is not in the closed position, S2316 may include transferring the container 200 into the reject bin 2104. Transferring the container 200 into the reject bin 2104 may include moving the conveyor belt 1220 in the conveyance direction 1326 and dropping the container 200 over the reject bin 2104.

S2316 may further include performing a second inspection of the container 200, such as when the container 200 passes the first inspection and/or is on the exit conveyor 2106. Performing the second inspection may include determining whether any product is outside of the container (e.g., caught between the container base 202 and lid 204 and/or present within a desired or predetermined region surrounding the container 200), or any other suitable inspection. The control system 118 may be configured to determine whether any product 2400 is outside of the container 200 by processing a signal from the seventh sensor (see discussion regarding sensor 2204 of FIG. 22A).

The container 200 may pass the second inspection if no product is outside of the container 200, and/or based on any other desired or predetermined criteria. If the container 200 passes the second inspection, the container 200 may be undergo further inspection (e.g., metal detection and/or weight determination) and/or labeled, sealed, and/or packaged with other containers. In at least one example embodiment, the exit conveyor 2106 is configured to transfer the container to another apparatus, such as to a receiving conveyor of another apparatus. Otherwise, if the container 200 fails the second inspection, it may be transferred into the reject bin 2104 or another reject bin, such as by operation of the third air nozzle (see discussion related to air nozzle 2230 of FIG. 22A). The method may end.

While some example embodiment have been disclosed herein, it should be understood that other variations may be possible. Such variations are not to be regarded as a departure from the spirit and scope of the present disclosure, and all such modifications as would be obvious to one skilled in the art are intended to be included within the scope of the following claims. For example, shapes and/or dimensions are not limited to those shown and may be modified, such as to accommodate different containers and/or or products.

Although described with reference to specific examples and drawings, modifications, additions and substitutions of example embodiment may be variously made according to the description by those of ordinary skill in the art. For example, the described techniques may be performed in an order different with that of the methods described, and/or elements such as the described system, architecture, devices, circuit, and the like, may be connected or combined to be different from the above-described methods, or results may be appropriately achieved by other elements or equivalents.

We claim:

1. A system for a filling a plurality of containers with products, the system comprising:

a shuttle assembly configured to move between a first location to receive a plurality of products and a second location to release the plurality of products into the containers, the shuttle assembly including, a body defining a plurality of apertures, a plurality of air-permeable gates configured to move with respect to the body between a first gate position and a second gate position, and a gate bar, the plurality of air-permeable gates extending from the gate bar, in the first gate position, each of the plurality of air-permeable gates extends transversely across a respective one of the plurality of apertures so as to retain the products within the plurality of apertures, and in the second gate position, each of the plurality of air-permeable gates is at least partially outside of the respective one of the plurality of apertures so as to no longer retain the products within the apertures.

2. The system of claim 1, wherein each of the plurality of air-permeable gates includes a plurality of tines spaced apart from one another to define a plurality of gaps.

3. The system of claim 1, wherein the gate bar defines a receptacle configured to receive a protrusion to move the plurality of air-permeable gates between the first gate position and the second gate position.

4. The system of claim 3, further comprising:

a gate actuator assembly configured to engage the gate bar to move the plurality of air-permeable gates between the first gate position and the second gate position, the gate actuator assembly including, a fixed portion, and a movable portion.

5. The system of claim 4, wherein the movable portion includes a protrusion configured to be at least partially received in the receptacle to engage the gate bar.

6. The system of claim 1, wherein each of the plurality of air-permeable gates defines a partially circular distal edge.

7. The system of claim 1, wherein the plurality of apertures defines a linear arrangement.

8. A system for filling a plurality of containers with products, the system comprising:

a container station configured to provide a plurality of containers to a container loading station, the container station including, a nest configured to individually and sequentially receive each of a plurality of containers, and a pair of pinchers configured to deform opposing sides of each of the plurality of containers in the nest, each of the pair of pinchers coupled to a respective piston; and a shuttle assembly configured to receive a plurality of products in a first shuttle position and move to a second shuttle position to deposit the plurality of products in the plurality of containers at the container loading station.

9. The system of claim 8, wherein the container station further includes a blade configured to engage a lid of each of the plurality of containers and at least partially open each of the plurality of containers.

10. The system of claim 8, further comprising:

a plurality of transfer wires defining a transfer passage configured to sequentially transfer each of the plurality of containers from the nest to the container loading station.

11. The system of claim 10, wherein the transfer passage defines a serpentine shape.

12. A system for filling a plurality of containers with products, the system comprising:

a product metering station including, a plurality of lanes, each of the plurality of lanes including, an upper passage, a lower passage, and a first gate between the upper passage and the lower passage, the first gate configured to move between a first gate position in which the first gate extends transversely across the lane so as to retain products within the lane, and a second gate position in which the first gate is at least partially outside of the lane so as to permit the products to move through the lane;

a shuttle assembly configured to move between the product metering station to receive a plurality of products; and a container loading station to deposit the plurality of products into containers, the container loading station including, a vacuum configured to engage lids of the containers to retain the containers in an open position.

13. The system of claim 12, wherein the shuttle assembly includes a plurality of second gates configured to move between a third gate position and a fourth gate position, in the third gate position, the second gate is configured to retain the plurality of products in the shuttle assembly, and in the fourth gate position, the second gate is configured to no longer retain the plurality of products in the shuttle assembly.

14. The system of claim 13, wherein the container loading station further includes a gate actuator assembly configured to move the plurality of second gates between the third gate position and the fourth gate position.

15. The system of claim 12, wherein the container loading station further includes a plurality of tampers configured to move between a first tamper position spaced apart from the containers and a second tamper position at least partially within interior regions of the containers.

16. The system of claim 15, wherein the container loading station further includes a guide block configured to direct the products from the shuttle assembly to the containers, and the guide block defines a plurality of apertures through which the plurality of products pass.

17. The system of claim 16, wherein the guide block is configured to move between a first guide block position spaced apart from the containers to a second guide block position to engage lids of the containers and close the containers.

18. A system for a filling a plurality of containers with products, the system comprising:

a shuttle assembly configured to move a plurality of products between a first location to receive the plurality of products and a second location to release the plurality of products into the containers, the shuttle assembly including, a body defining a plurality of apertures, a plurality of air-permeable gates configured to move with respect to the body between a first gate position and a second gate position, each of the plurality of air-permeable gates including, a plurality of tines spaced apart from one another to define a plurality of gaps, in the first gate position, each of the plurality of air-permeable gates extends transversely across a respective one of the plurality of apertures so as to retain the products within the plurality of apertures, and in the second gate position, each of the plurality of air-permeable gates is at least partially outside of the respective one of the plurality of apertures so as to no longer retain the products within the apertures.

19. A system for a filling a plurality of containers with products, the system comprising:

a shuttle assembly configured to move a plurality of products between a first location to receive the plurality of products and a second location to release the plurality of products into the containers, the shuttle assembly including, a body defining a plurality of apertures, a plurality of air-permeable gates configured to move with respect to the body between a first gate position and a second gate position, each of the plurality of air-permeable gates defining a partially circular distal edge in the first gate position, each of the plurality of air-permeable gates extends transversely across a respective one of the plurality of apertures so as to retain the products within the plurality of apertures, and in the second gate position, each of the plurality of air-permeable gates is at least partially outside of the respective one of the plurality of apertures so as to no longer retain the products within the apertures.

20. A system for filling a plurality of containers with products, the system comprising:

a product metering station including, a plurality of lanes, each of the plurality of lanes including, an upper passage, a lower passage, and a first gate between the upper passage and the lower passage, the first gate configured to move between a first gate position in which the first gate extends transversely across the lane so as to retain products within the lane, and a second gate position in which the first gate is at least partially outside of the lane so as to permit the products to move through the lane;

a shuttle assembly configured to move between the product metering station to receive a plurality of products; and a container loading station to deposit the plurality of products into containers the container loading station including, a plurality of tampers configured to move between a first tamper position spaced apart from the containers and a second tamper position at least partially within interior regions of the containers, and a guide block configured to direct the products from the shuttle assembly to the containers, and to move between a first guide block position spaced apart from the containers to a second guide block position to engage lids of the containers and close the containers the guide block defining a plurality of apertures through which the plurality of products pass.

* * * * *